US009580268B2

(12) United States Patent
Nagashima et al.

(10) Patent No.: US 9,580,268 B2
(45) Date of Patent: Feb. 28, 2017

(54) ARTICLE RECEIVING DEVICE

(71) Applicant: CANON KABUSHIKI KAISHA, Tokyo (JP)

(72) Inventors: Masakazu Nagashima, Yokohama (JP); Tetsuo Kikuchi, Ayase (JP); Daiki Anayama, Yokohama (JP); Ryo Harigae, Koganei (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/859,593

(22) Filed: Sep. 21, 2015

(65) Prior Publication Data

US 2016/0090261 A1 Mar. 31, 2016

(30) Foreign Application Priority Data

Sep. 30, 2014 (JP) ..... 2014-201070

(51) Int. Cl.

*B65H 31/00* (2006.01)
*B65H 31/22* (2006.01)
*B65H 31/02* (2006.01)

(52) U.S. Cl.

CPC ..... *B65H 31/22* (2013.01); *B65H 31/02* (2013.01); *B65H 2301/4212* (2013.01); *B65H 2402/10* (2013.01); *B65H 2402/42* (2013.01); *B65H 2402/531* (2013.01); *B65H 2402/63* (2013.01); *B65H 2405/11151* (2013.01); *B65H 2511/20* (2013.01); *B65H 2511/21* (2013.01); *B65H 2511/212* (2013.01); *B65H 2511/512* (2013.01); *B65H 2551/29* (2013.01);

(Continued)

(58) Field of Classification Search

CPC ..... B65H 29/00; B65H 29/125; B65H 31/22; B65H 31/26
USPC ..... 271/207, 213, 3.14, 278
See application file for complete search history.

(56) References Cited

U.S. PATENT DOCUMENTS 5,666,595 A 9/1997 Sameshima et al.
5,816,723 A 10/1998 Takahashi et al.
6,663,099 B2 12/2003 Inoue (Continued)

FOREIGN PATENT DOCUMENTS

CN 1288819 3/2001
JP 11-079430 3/1999

(Continued)

OTHER PUBLICATIONS

Machine translation of JP 11-143157.*

(Continued)

*Primary Examiner* — Thomas Morrison
(74) *Attorney, Agent, or Firm* — Fitzpatrick, Cella, Harper & Scinto

(57) ABSTRACT

A receiving device that is connected to a sheet processing device to receive a sheet comprising: a receiving port that receives the sheet discharged from a discharge port of the sheet processing device: casters that support the receiving device on a floor; and a roller that rides up a support part provided with the sheet processing device at the time of connecting the receiving device and the sheet processing device to receive a part of the weight of the receiving device on the support part, wherein when the roller rides up the support part, a part of the casters floats up from the floor, and the receiving port is positioned to the discharge port.

13 Claims, 29 Drawing Sheets

(52) U.S. Cl.
CPC *B65H 2553/61* (2013.01); *B65H 2701/11312* (2013.01); *B65H 2801/12* (2013.01)

(56) References Cited

U.S. PATENT DOCUMENTS

| | | | | |
|---|---|---|---|---|
| 7,484,726 | B2 * | 2/2009 | Hashimoto | B65H 1/00 16/19 |
| 2002/0163118 | A1 * | 11/2002 | Inoue | B65H 5/38 271/162 |

FOREIGN PATENT DOCUMENTS

| | | | |
|---|---|---|---|
| JP | 11-143157 | * | 5/1999 |
| JP | 2003-002485 | | 1/2003 |
| JP | 4006289 | B2 | 11/2007 |
| JP | 2009-42413 | * | 2/2009 |

OTHER PUBLICATIONS

Unpublished, Copending U.S. Appl. No. 14/859,564, to Daiki Anayama, filed Sep. 21, 2015.
Chinese Office Action issued in corresponding Chinese Application No. 2016102700958040 dated Nov. 1, 2016.
Chinese Office Action issued in corresponding Chinese Application No. 201510632781.0 dated Nov. 1, 2016.

* cited by examiner

ARTICLE RECEIVING DEVICE

BACKGROUND OF THE INVENTION

Field of the Invention

The present invention relates to a receiving device that receives an article such as a sheet from another device.

Description of the Related Art

Japanese Patent Laid-Open No. H11-79430(1999) discloses a method in which a large-capacity sheet feeding device is provided with a sheet feeding unit and a conveying guide that are position-adjustable, and at the time of connecting a device body and the sheet feeding device, a position of each of the sheet feeding unit and the conveying guide is adjusted to a sheet taking-in position of the device body for the connection.

Japanese Patent Laid-Open No. 2003-2485 describes the structure that any of a receiving port in an image forming device and a delivery port of a large-capacity sheet feeding device is structured to be changeable in position in the upper-lower direction.

SUMMARY OF THE INVENTION

The present invention has an object of providing a method in which upon delivering an article from a device to another device, the delivery is less subjected to an influence of unevenness of a floor on which the device is placed. Another object of the present invention is to provide a method in which upon delivering an article from a device to another device, the appropriate delivery is made possible even if a deviation in inclination or height in at least one of the devices occurs.

Receiving device of the present invention is a receiving device that is connected to a sheet processing device to receive a sheet comprising:

a receiving port that receives the sheet discharged from a discharge port of the sheet processing device:

casters that support the receiving device on a floor; and a roller that rides up a support part provided with the sheet processing device at the time of connecting the receiving device and the sheet processing device to receive a part of the weight of the receiving device on the support part, wherein when the roller rides up the support part, a part of the casters floats up from the floor, and the receiving port is positioned to the discharge port.

According to the present invention, upon delivering an article from a device to another device, the delivery is less subjected to an influence of unevenness of a floor on which the device is placed. In addition, the appropriate delivery is made possible even if a deviation in inclination or height in at least one of the devices occurs.

Further features of the present invention will become apparent from the following description of exemplary embodiments (with reference to the attached drawings).

DESCRIPTION OF THE EMBODIMENTS

First Embodiment

Figure 1:
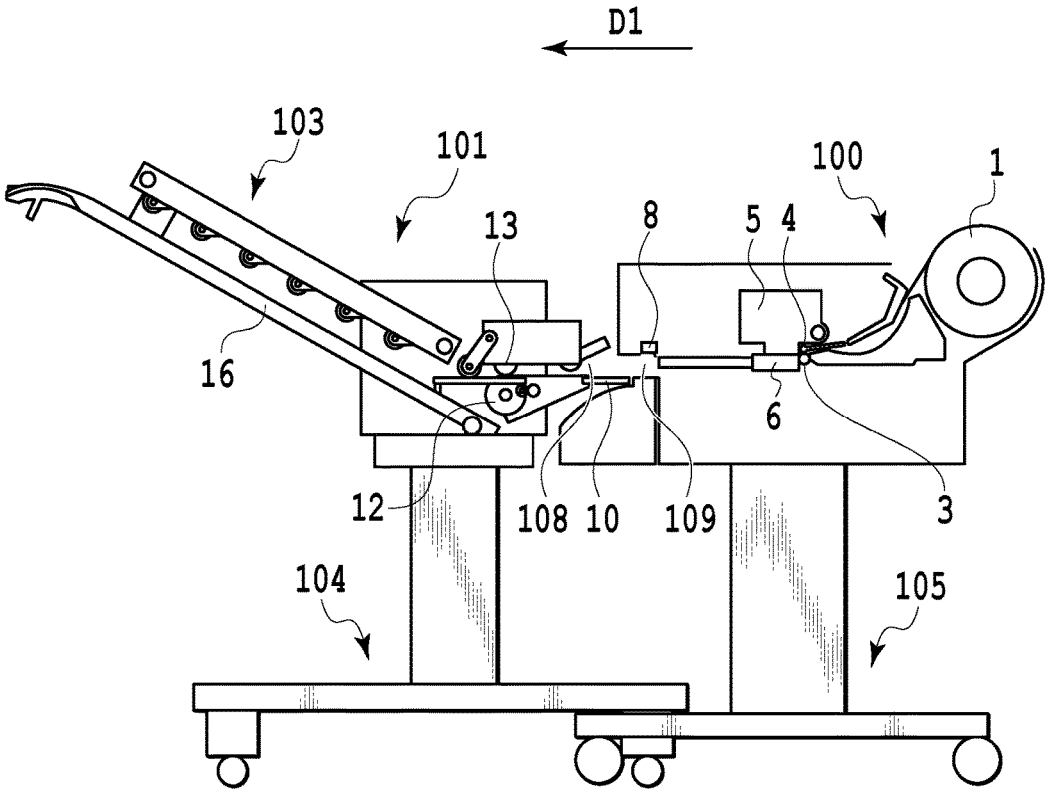
FIG. 1 is a sectional view illustrating an inkjet printing device and a stack device connected thereto according to embodiments of the present invention.

FIG. 1 is a sectional view illustrating an article delivery system comprising an inkjet printing device 100 (hereinafter, called "printer" as well) and a stack device 101 that is connected thereto and receives a printed sheet for stack according to embodiments in the present invention.

It should be noted that the present invention can be applied not only to a printer that performs the printing process on a sheet but also to a combination of a sheet processing device for executing various sheet processes (reading, coating, heat treatment, working and the like) and a stack device.

A roll sheet 1 as a print medium is set in the printer 100 (sheet processing device), and a sheet supplied from the roll sheet 1 is conveyed in a direction of arrow D1. The printer 100 is provided with an operating part for operating the printer. A user operates various kinds of switches and the like installed in this operating part to instruct a lateral width dimension of the roll sheet 1, online/offline, commands and the like.

The stack device 101 (receiving device) is installed downstream of the printer 100 in the conveying direction to receive the sheet for stack. The sheet supplied from the roll sheet 1 is conveyed into the printer 100, is tightly held between a conveying roller 3 and a pinch roller 4 as conveying means, and reaches onto a surface of a platen 6. A print head 5 as image forming means is arranged in a position facing the surface of the platen 6 to eject ink. Many suction holes for suction are formed in the platen 6 to prevent the sheet from floating up.

In addition, a duct communicated with the platen 6 is arranged under the platen 6, and further, a suction fan is arranged under the duct to be communicated with the duct to suction the sheet to the platen 6. Ink is ejected on a portion of the sheet placed on the platen 6, the portion being positioned in an image forming area, based upon image information from the print head 5 to print an image thereon. The sheet on which the image is printed is discharged from a printer opening port 109 (sheet discharge port or discharge opening of the printer) outside of the printer 100, passes a joint part 10 as a delivery part, and enters from an opening port 108 (sheet receiving port or sheet receiving opening of the stack device) into the stack device 101 to be loaded and supported therein.

Next, when the sheet on which the image is printed reaches the stack device 101, the conveying roller 12 starts to rotate, and the sheet is pinched in between the conveying roller 12 and the pinching roller 13 by a conveying force of the printer 100 to be sent to a tray unit 103. When the printing of the image is completed, a predetermined position of the sheet is conveyed to a cut position, where the sheet is cut by a cutter 8. After that, the sheet is conveyed by the conveying roller 12 of the stack device 101 to be discharged to a tray 16.

Figure 2:
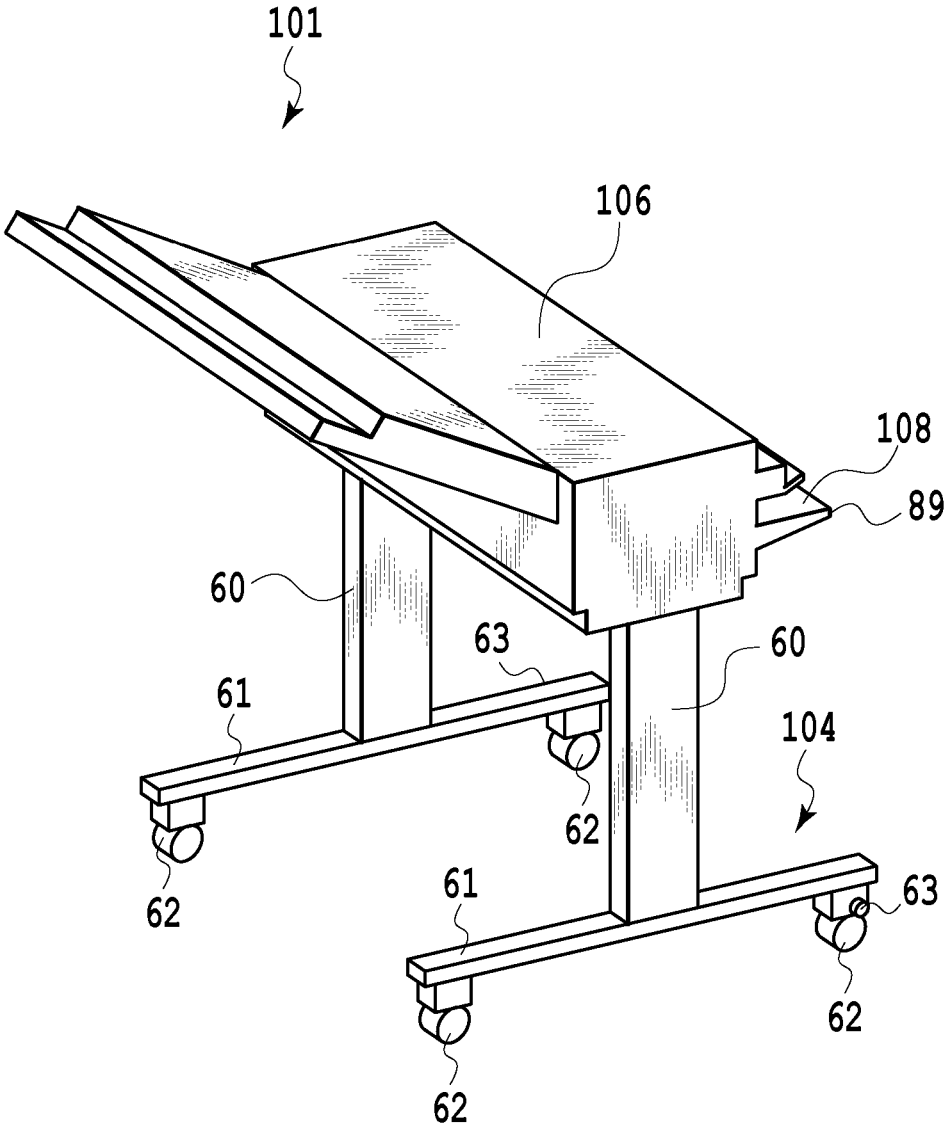
FIG. 2 is a perspective view illustrating the stack device to which a first embodiment of the present invention is applicable.

FIG. 2 is a perspective view illustrating the stack device 101. Hereinafter, an explanation will be made of the stack device 101 with reference to FIG. 2. The stack device 101 is configured of a stack device unit 106 and a stand unit 104. The stack device unit 106 is provided with the opening port 108 (a sheet receiving port of the stack device) for carrying a sheet therein. The stack device unit 106 is installed in the movable stand unit 104, and can freely move on a floor by an operation of a user. A basic structure of the stand unit 104 is formed to arrange stack device legs 60 to the right and left in the stack device unit 106 such that the opening port 108 provided in the stack device unit 106 is equal in height to the printer opening port 109.

In addition, for securing the stability of the stack device 101, foot parts 61 each having a sufficient length are connected to the stack device legs 60 respectively. Casters 62 that move on a floor in a rolling structure are arranged in both ends of each of the foot parts 61, and a stand unit 104 body is provided with the four casters 62. In the stack device 101 at the regular time that is not connected to any device, the casters 62 abut on the floor, and therefore the stack device 101 itself moves upward and downward subjected to an influence of the unevenness of the floor.

Here, each of the right and left foot parts 61 has a lateral face that is provided with a roller 63 (supported part) that is positioned substantially right under the opening port 108 and extends outside of the stand unit 104. The roller 63 is rotatable and is arranged in a position higher than the caster 62, and therefore does not make contact with the floor at a regular posture in use and is not subjected to the influence of the unevenness of the floor.

Figure 3:
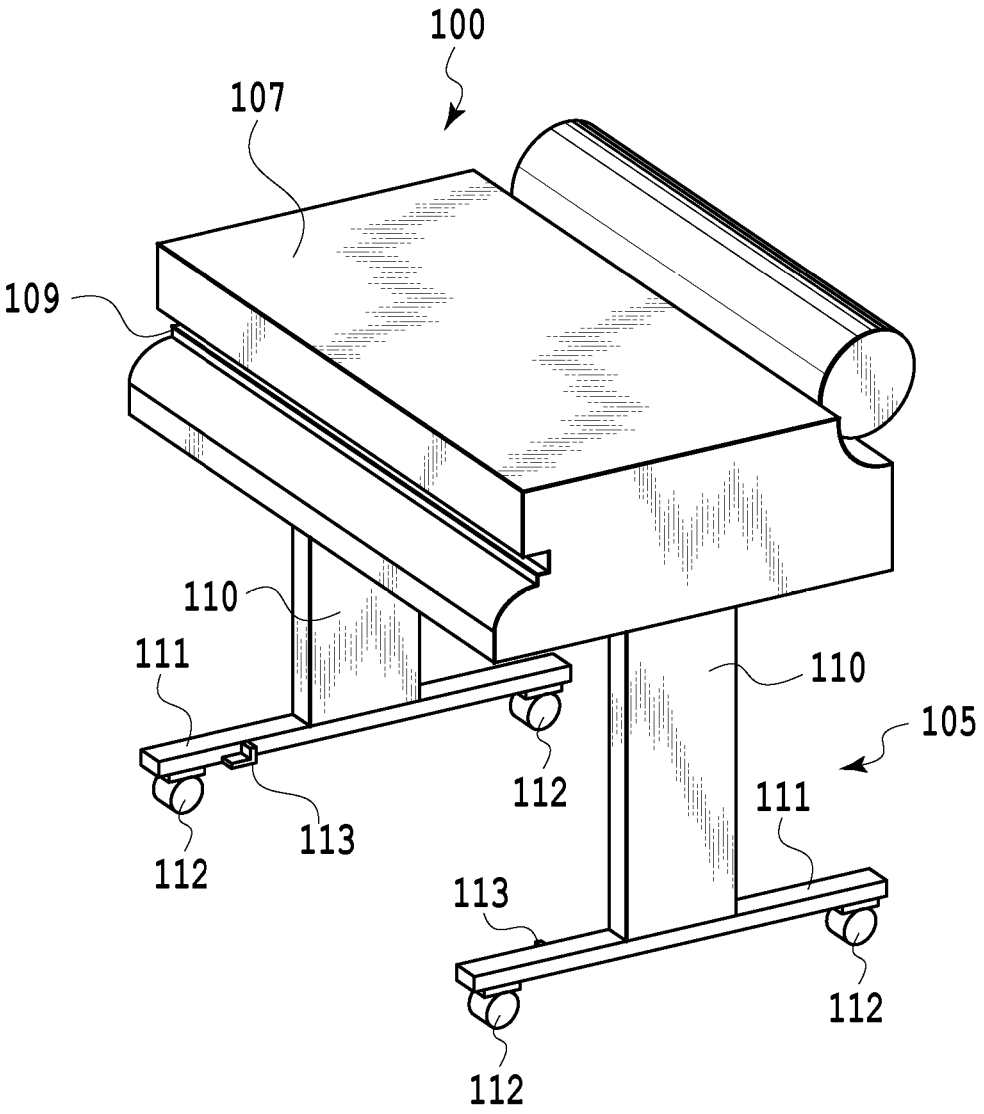
FIG. 3 is a perspective view illustrating a printer to which the first embodiment is applicable.

FIG. 3 is a perspective view illustrating the printer 100. Hereinafter, an explanation will be made of the printer 100 with reference to FIG. 3. The printer 100 is provided with a printer unit 107 and a printer stand unit 105. The printer unit 107 is provided with the printer opening port 109 (sheet discharge port) for discharging a sheet. The printer unit 107 is installed in the movable printer stand unit 105, and can freely move on the floor by an operation of a user. A basic structure of the printer stand unit 105 is formed to arrange printer legs 110 to the right and left in the printer unit 107 for setting the height in consideration of operability of the printer unit 107. In addition, for securing the stability of the printer 100, printer foot parts 111 each having a sufficient length are connected to the printer legs 110 respectively.

Casters 112 that move on a floor in a rolling structure are arranged in both ends of each of the printer foot parts 111, and the printer stand unit 105 is provided with the four casters 112 as a whole. The printer 100 is in a state where the casters 112 abut on the floor and the printer 100 moves upward and downward subjected to the influence of the unevenness of the floor. Here, each of the right and left printer foot parts 111 has a lateral face that is provided with a roller receiving board 113 that is positioned substantially right under the opening port 109 and extends inside of the printer stand unit 105. The roller receiving board 113 is arranged in a position higher than the caster 112, and therefore does not make contact with the floor and is not subjected to the influence of the unevenness of the floor.

Figure 4:
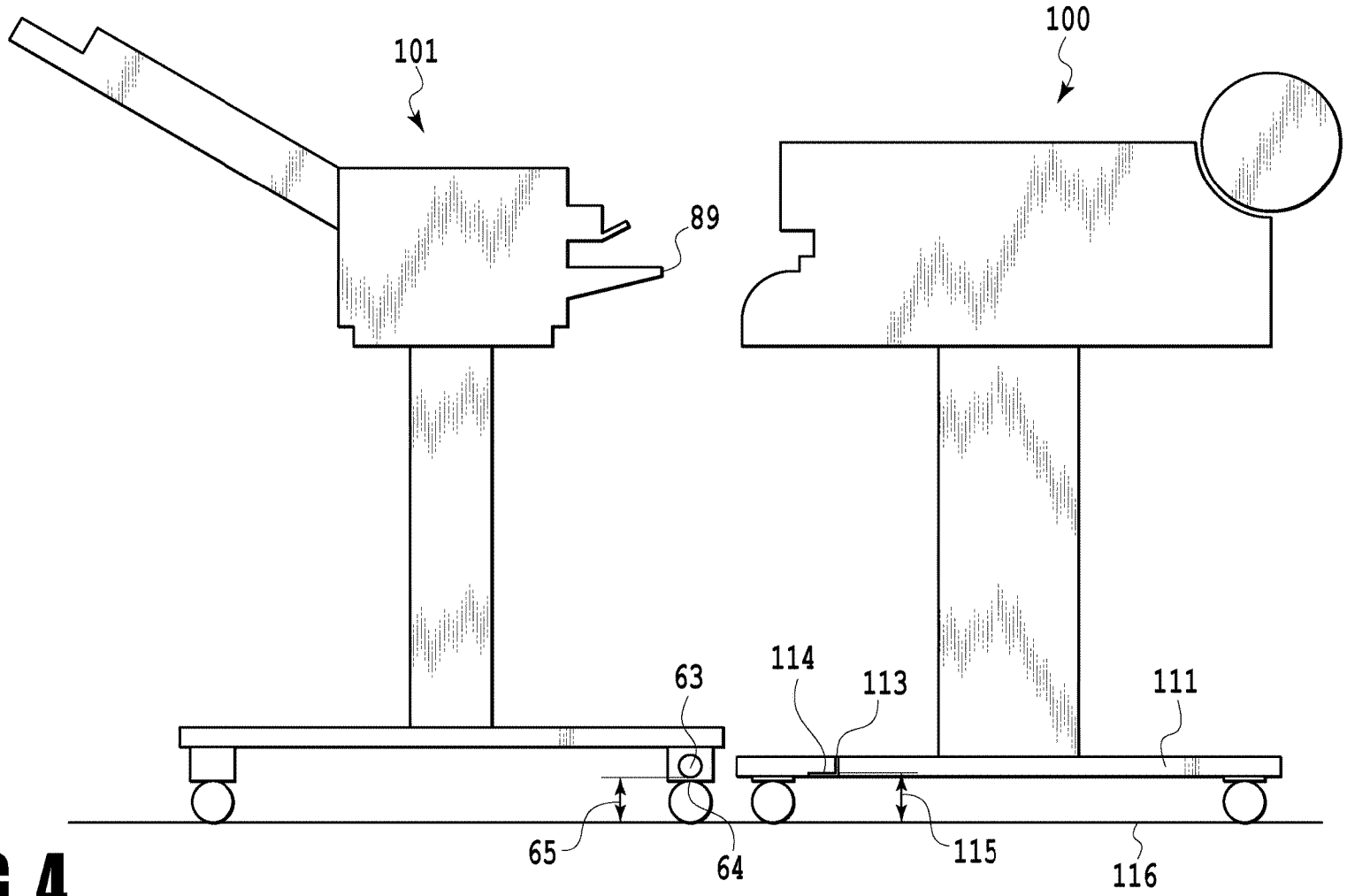
FIG. 4 is a side view illustrating a state where the stack device is separated from the printer.
Figure 5:
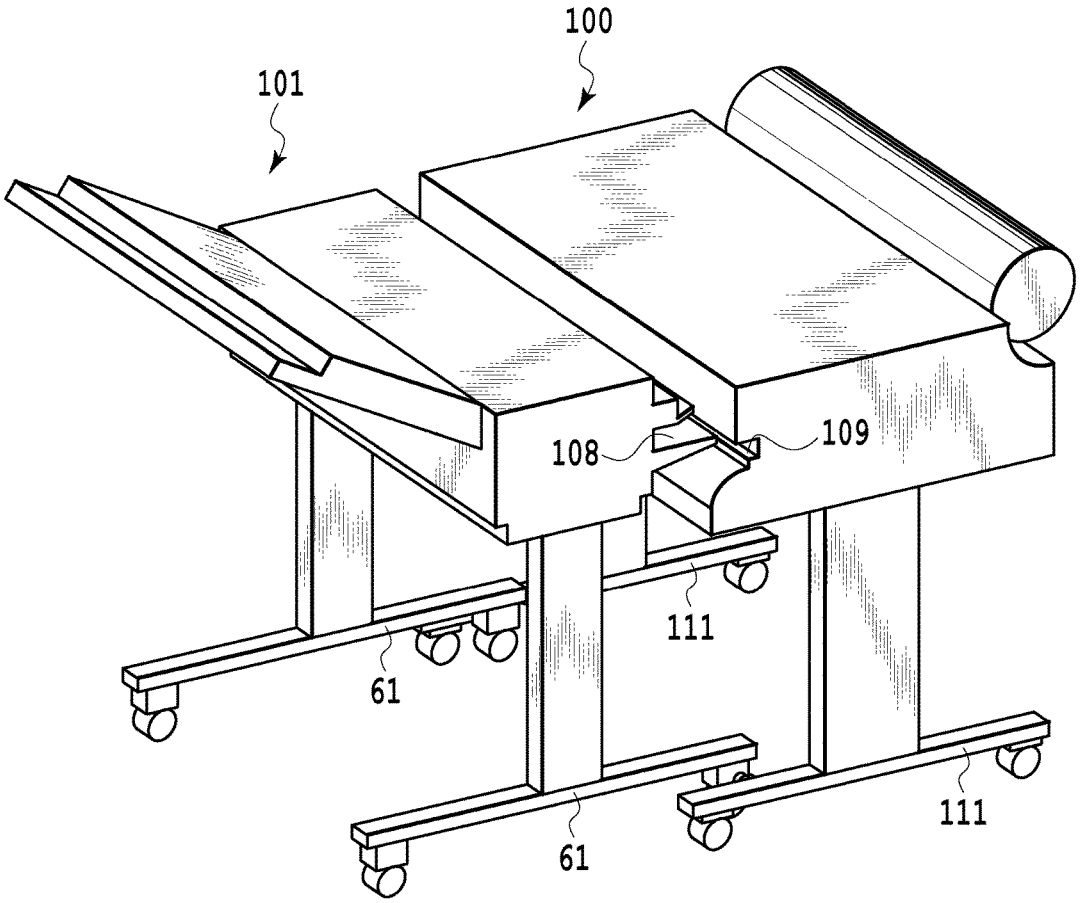
FIG. 5 is a perspective view illustrating a state where the stack device is connected to the printer.

FIG. 4 is a side view illustrating a state where the stack device 101 is separated from the printer 100. FIG. 5 is a perspective view illustrating a state where the stack device 101 is connected to the printer 100. Hereinafter, an explanation will be made of the connection part in which the stack device 101 as a device that receives a sheet as an article is connected to the printer 100 as a sheet processing device.

At the time of connecting the stack device 101 and the printer 100, the roller 63 in the stack device 101 rides up a roller receiving face 114 of the printer 100 (support part of the printer). When the roller 63 rides up the roller receiving face 114, the roller 63 is engaged to the roller receiving face 114 such that the roller 63 does not drop off the roller receiving face 114. In a state where the stack device 101 and the printer 100 are connected, the printer 100 supports a part of the weight of the stack device 101. Here, a portion of the roller 63 in the stack device 101, the portion being the closest to a floor 116, is defined as the roller lowest point 64 and a distance from the roller lowest point 64 to the floor 116 is defined as a roller height 65.

In addition, an upper face of a portion of the roller receiving board 113 provided in the printer foot part 111 of the printer 100, the portion receiving the roller 63 thereon, is defined as the roller receiving face 114, and a distance from the roller receiving face 114 to the floor 116 is defined as a receiving board height 115. At this time, a height relation of roller height 65<receiving board height 115 is established. That is, in a state where the stack device 101 and the printer 100 are connected and the roller 63 rides up the roller receiving board 113, the caster 62 provided in a lower part of the roller 63 in the stack device 101 floats up from the floor 116.

Figure 6:
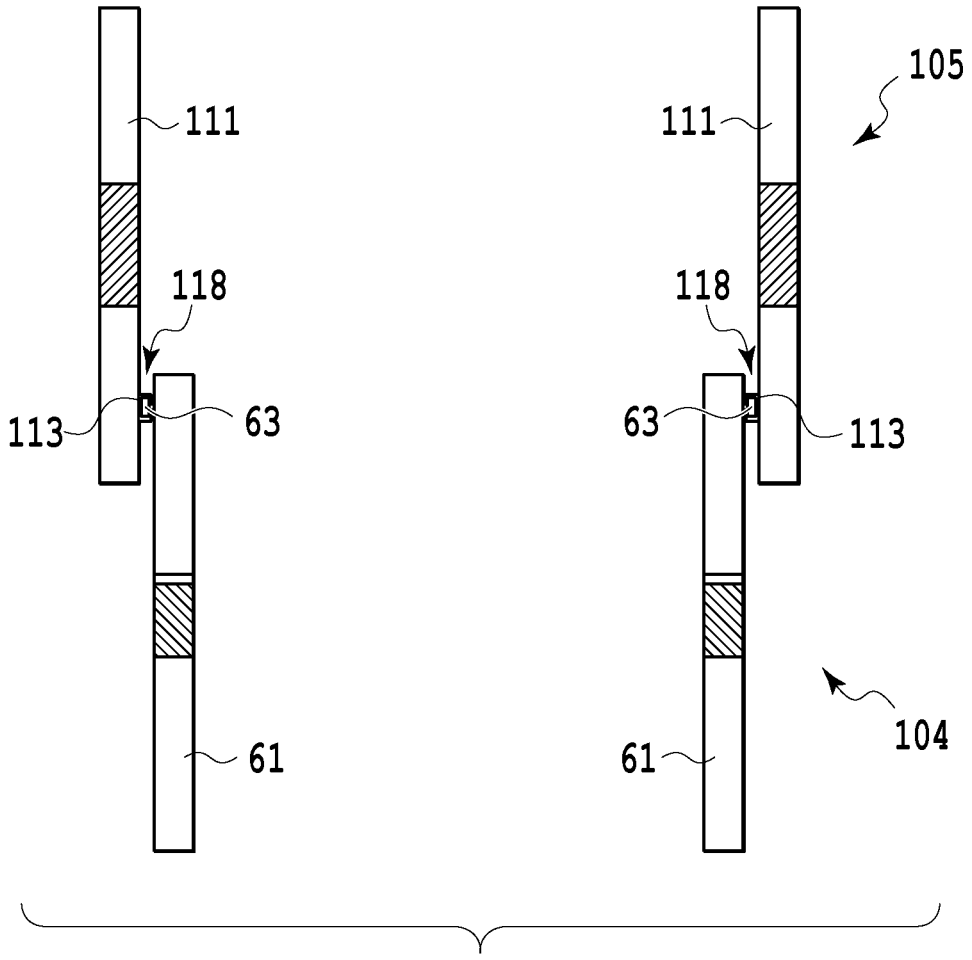
FIG. 6 is a top view illustrating connection parts between the stack device and the printer as viewed from the top.
Figure 7:
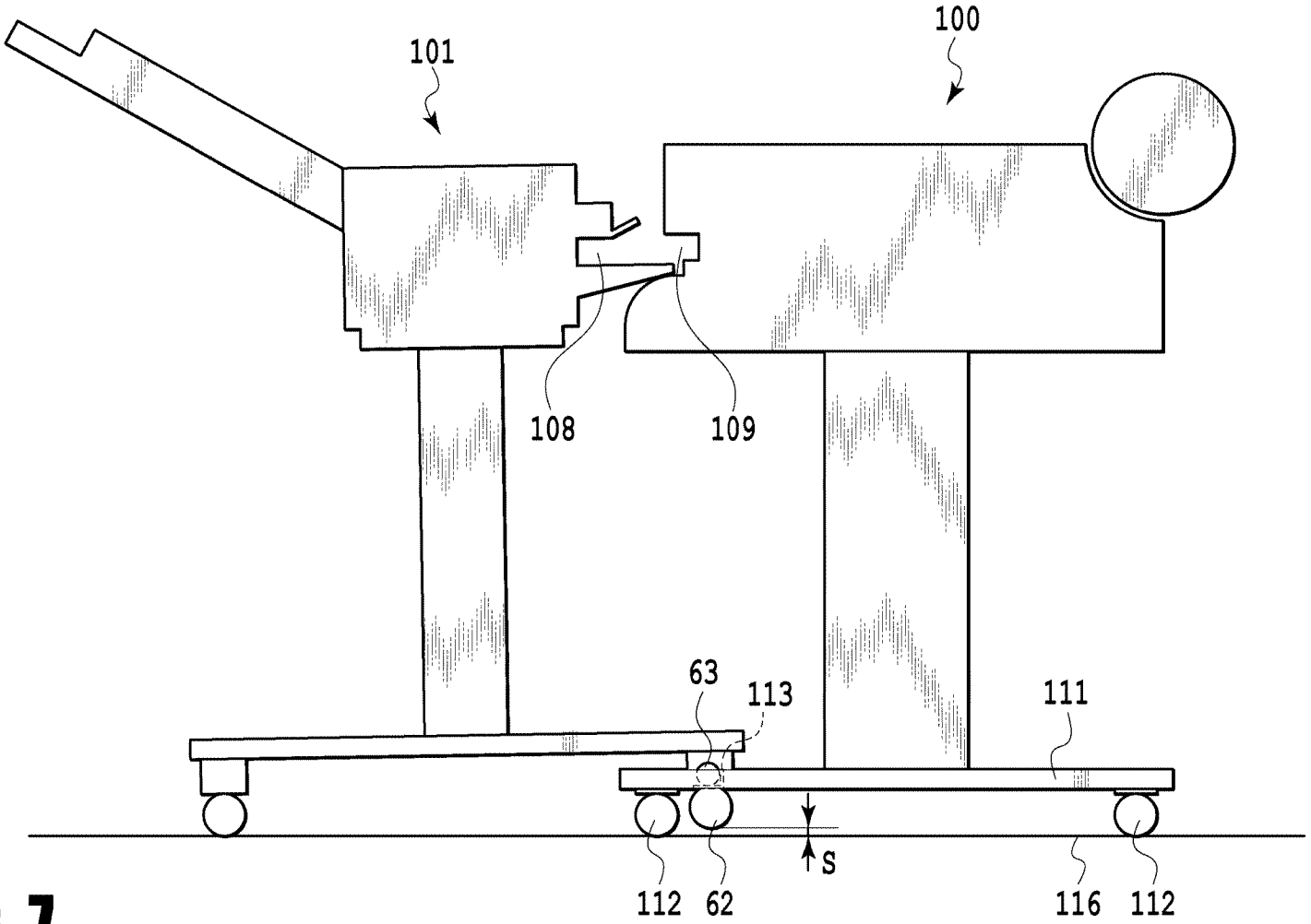
FIG. 7 is a side view illustrating a state where the stack device is connected to the printer.

FIG. 6 is a top view illustrating connection parts between the stack device 101 and the printer 100 as viewed from the top, and FIG. 7 is a side view illustrating a state where the stack device 101 is connected to the printer 100.

An interval between the right and left foot parts 61 in the stack device 101 is narrower than an interval between the right and left printer foot parts 111 in the printer 100. Therefore at the time of connecting the stack device 101 and the printer 100, the right and left foot parts 61 are connected to the right and left printer foot parts 111 by inserting the right and left foot parts 61 in the stack device 101 into an inside of the right and left printer foot parts 111 in the printer 100. In a state where the stack device 101 and the printer 100 are connected and the roller 63 rides up the roller receiving board 113, the opening port 108 (sheet receiving port) and the printer opening port 109 (sheet discharge port) are sufficiently close to each other, thus making it possible to perform the delivery of the sheet accurately.

That is, connecting the stack device 101 and the printer 100 causes the opening port 108 in the stack device 101 to approach a position of the printer opening port 109 on a basis of the position of the printer opening port 109.

In the connected state, the right and left foot parts 61 are inserted in between the right and left printer foot parts 111, and a slight foot space 118 is formed between the foot part 61 and the printer foot part 111. The roller 63 provided on the lateral face of the foot part 61 is engaged to the roller receiving board 113 provided on the lateral face of the printer part 111 in the foot space 118, and the roller 63 rides up the roller receiving board 113.

In the riding-on state, the opening port 18 is substantially equal in height to the printer opening port 109, which creates a state where the delivery of the sheet can be made with accuracy. In addition, in the connected state the caster 62 in the connection part in the stack device 101 is separated from the floor 116 by a separation amount S=receiving board height 115−roller height 65 by a relation of roller height 65<receiving board height 115 as described before, and therefore the caster 62 is not influenced by the unevenness of the floor 116. It should be noted that there is no change in the state where the caster 112 in the printer 100 maintains the abutment on the floor 116 at the connection time. In addition, since the stack device 101 is connected to the printer 100 just by the roller 63 riding on the roller receiving board 113 in the printer 100, a predetermined amount of the unevenness of the floor can be absorbed.

Figure 8:
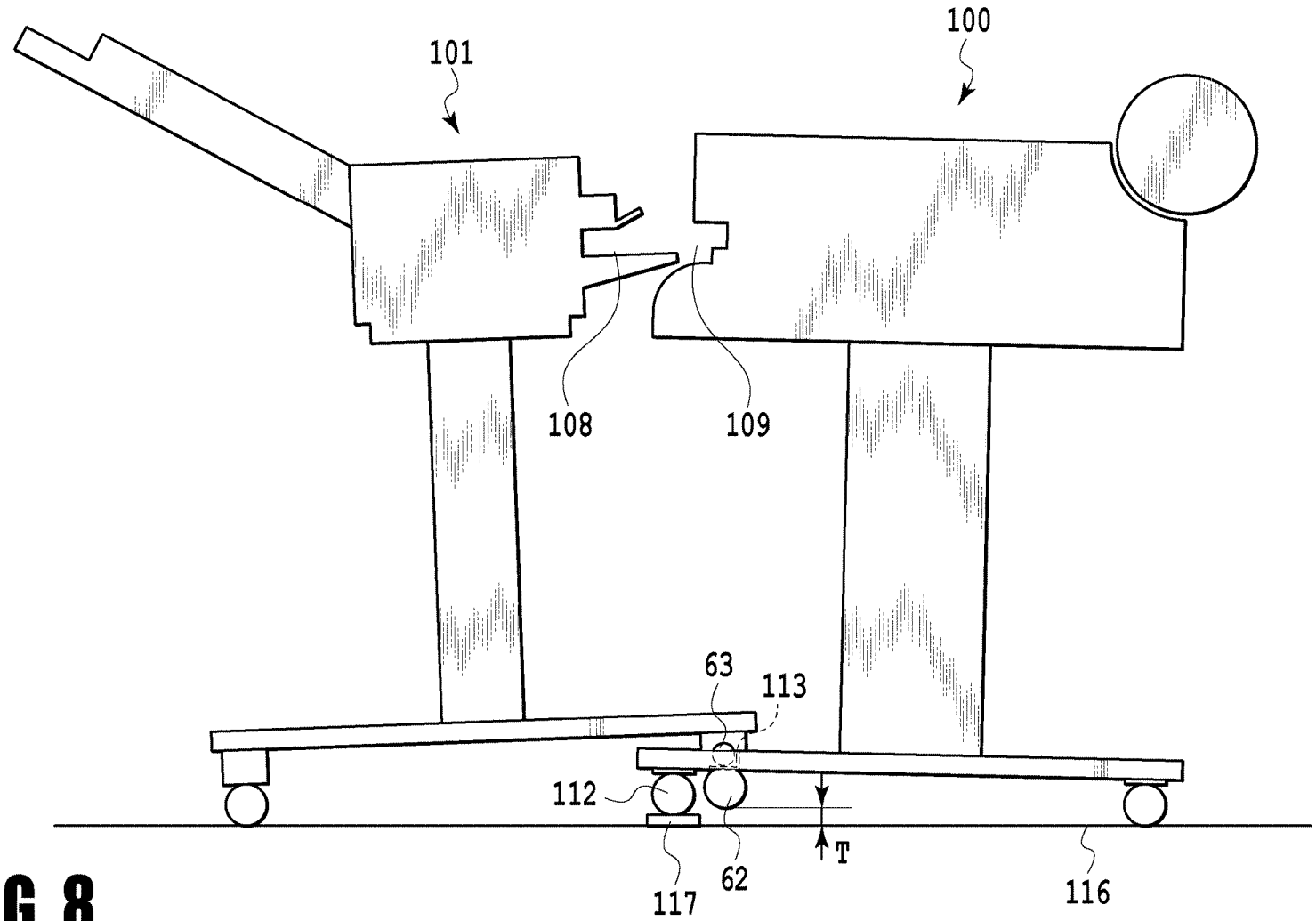
FIG. 8 is a side view illustrating a state where the stack device is connected to the printer.

FIG. 8 is a side view illustrating a state where the stack device 101 is connected to the printer 100 on a condition that the floor has an uneven surface. Here, an explanation will be made of the connection between the stack device 101 and the printer 100 in a case where the floor on which the stack device 101 and the printer 100 are installed has a convex part.

An explanation will be made of a case where the floor 116 has a convex part 117 and the caster 112 in the printer 100 rides up the convex part 117 for installation as an example. In this case, a separation amount T of the caster 62 from the floor 116 increases by the height of the convex part 117 more than the separation amount S. Here, as described above, the stack device 101 is configured to ride on the printer 100 and further, the roller 63 and the roller receiving board 113 are respectively positioned substantially right under the opening port 108 and the printer opening port 109. Therefore at the connecting time, a relative position of the printer opening port 109 to the opening port 108 is slightly separated from each other, but the delivery of the sheet can be made with accuracy.

In this way, since the stack device 101 is connected to the printer 100 in a state of riding on it, even in a case where the floor has the unevenness surface, the delivery of the sheet can be made with accuracy. Thereby it is possible to prevent bend of the sheet conveyance, damages such as sheet break, and conveyance defects such as sheet clogging.

It should be noted that the explanation is made of the mode in which the stack device 101 rides up the printer 100, but in reverse, even in the structure that the printer 100 rides up the stack device 101, the similar effect can be obtained.

Figure 9:
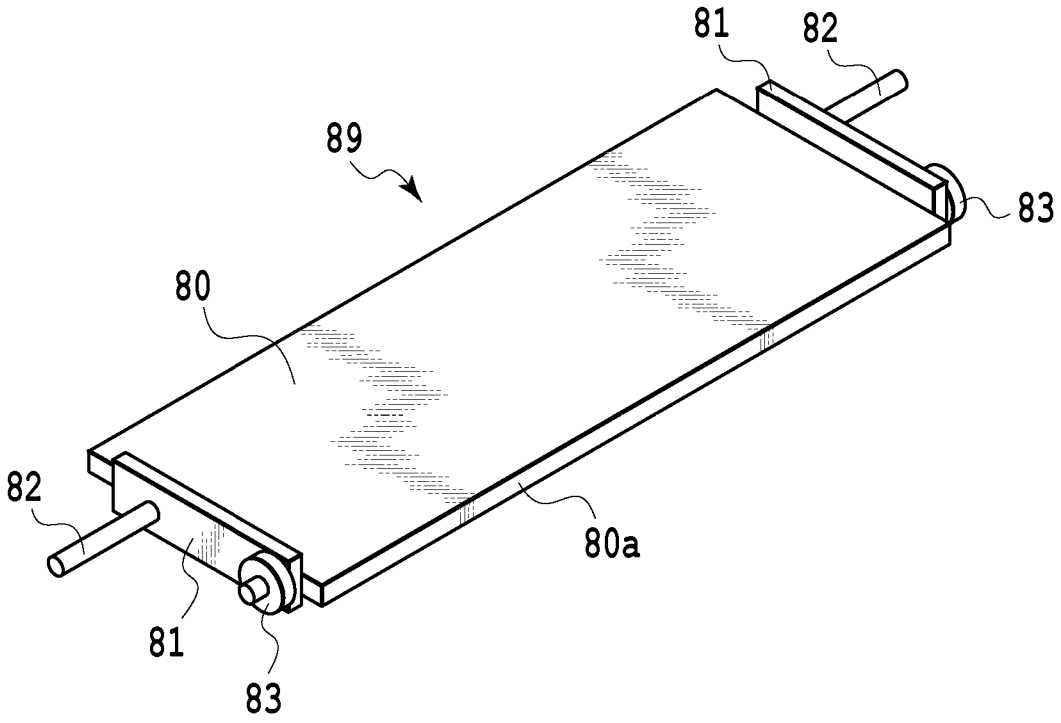
FIG. 9 is a perspective view illustrating a sheet receiving part unit in a joint part between the stack device and the printer.

FIG. 9 is a perspective view illustrating a sheet feeding part unit 89 (receiving member) in the joint part 10 between the stack device 101 and the printer 100. FIG. 9 is used to explain the structure of the joint part 10 in which the delivery of the sheet between the stack device 101 and the printer 100 is made. The sheet feeding part unit 89 is provided with a plate-shaped sheet feeding part 80 (receiving member), and at the sheet delivery time, the sheet is conveyed on the sheet feeding part 80. A face of the sheet feeding part 80, the sheet being conveyed on the face, is formed having surface roughness optimal for the sheet conveyance.

In the present embodiment, when a sheet is fed in a state where a tangent line in a tip part of a plain sheet (roll sheet) discharged from the printer 100 is formed at an angle of 45 degrees to the face, on which the sheet is conveyed, of the sheet feeding part 80, there is used the sheet that is not engaged to the sheet feeding part 80. A size of the sheet feeding part 80 is preferably made to match a size of a feeding sheet, and in the present embodiment, for feeding the roll sheet having 60-inch width at the maximum, the sheet feeding part 80 having a width of 60 inches or more is used. In addition, a length of the sheet feeding part 80 in the conveying direction is set to any length.

A striking part 80*a* is formed in a tip of the sheet feeding part 80, the striking part 80*a* being struck on a striking part 9*a* (refer to FIG. 12A) of a sheet discharge guide, which will be described later, in the printer 100. Side plates 81 are provided in both ends of the sheet feeding part 80 in the width direction, and each of the side plates 81 is provided with a rotational shaft 82 and a roller 83.

Figure 10:
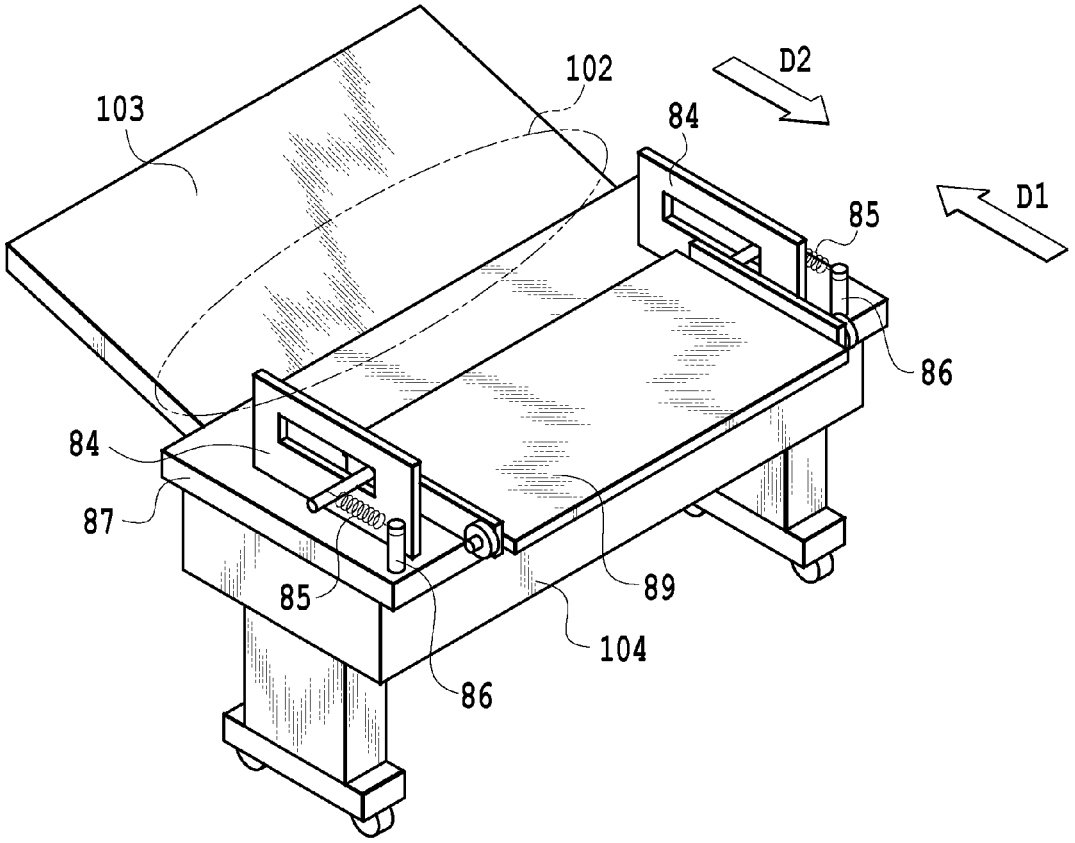
FIG. 10 is a perspective view illustrating the stack device.

FIG. 10 is a perspective view illustrating the stack device 101. Sheet feeding part guide side plates 84 are provided in two locations on a lower stay 87 of the stack device. The sheet feeding part guide side plate 84 has an elongated hole that is sized for the rotational shaft 82 of the sheet feeding part unit 89 to be inserted therein and to be slidable in a direction of arrow D1 as the conveying direction. The lower stay 87 is provided thereon with two spring engaging parts 86 in both the ends in an axial direction of the rotational shaft 82. When an urging spring 85 is engaged to the spring engaging part 86 and the rotational shaft 82, the sheet feeding part unit 89 is urged in a direction of arrow D2 as an insert direction of the stack device.

Figure 11:
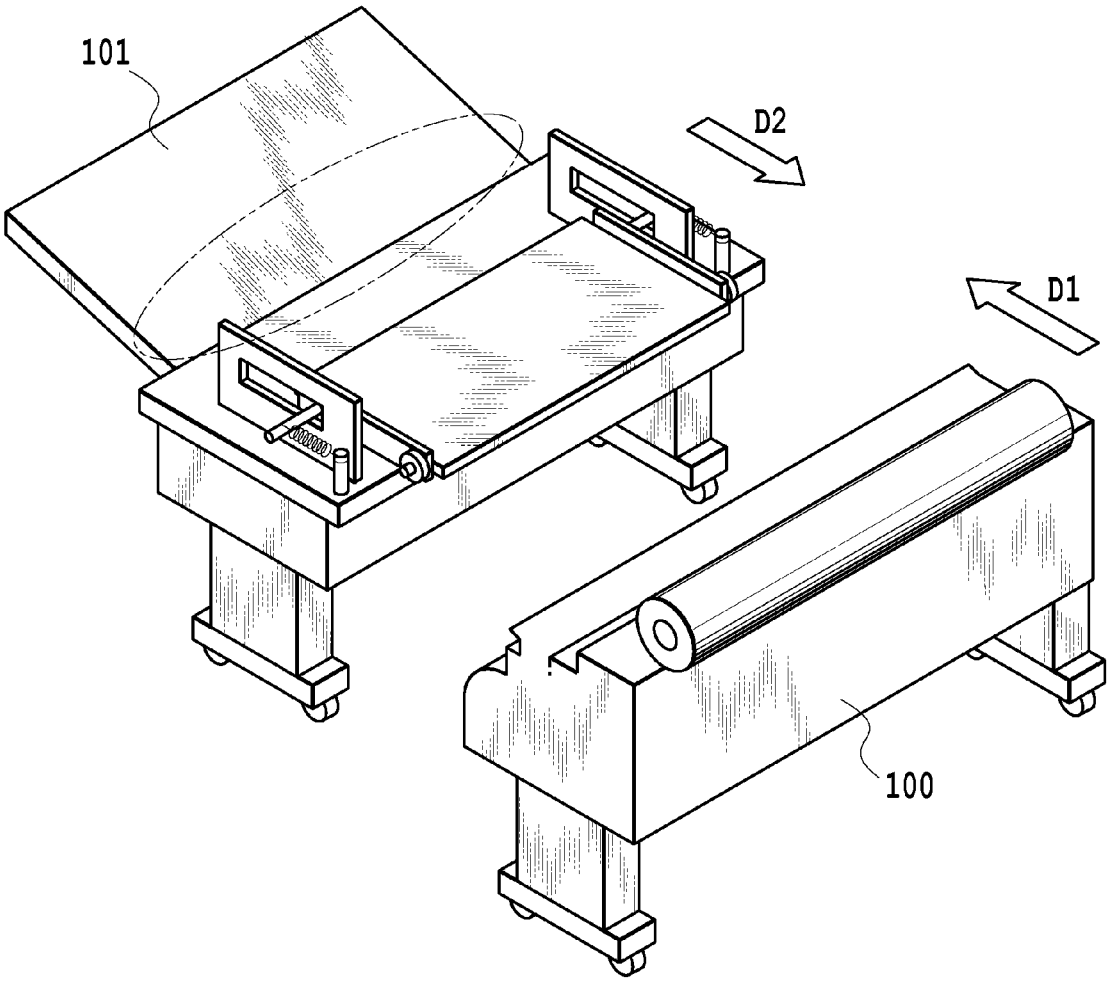
FIG. 11 is a perspective view illustrating the printer and the stack device in a state before being connected to each other.
Figure 12A:
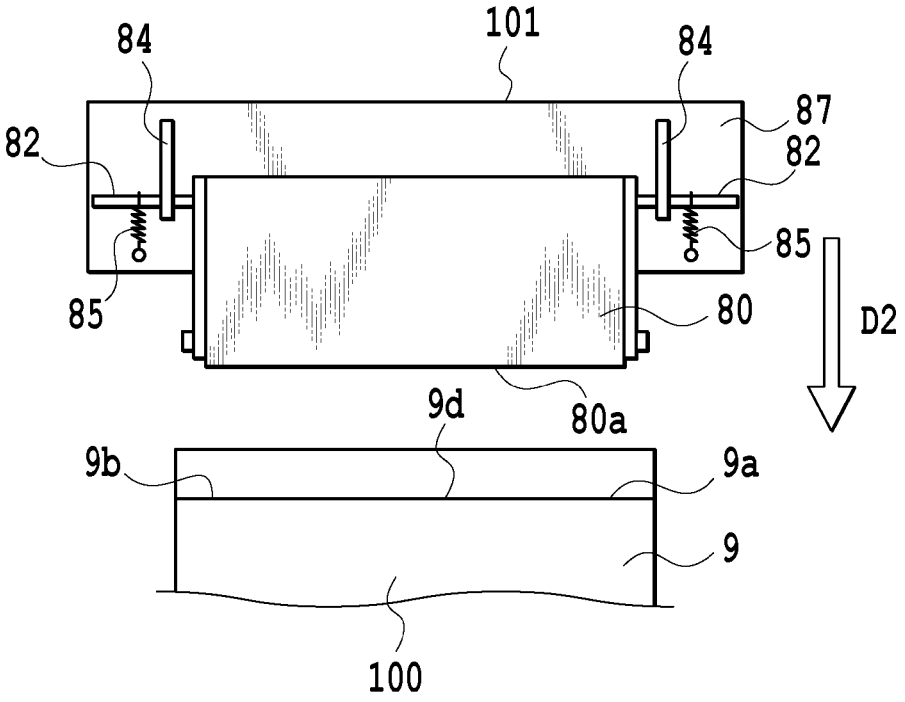
FIG. 12A is a top view illustrating the printer and the stack device at the time of being connected to each other.
Figure 12B:
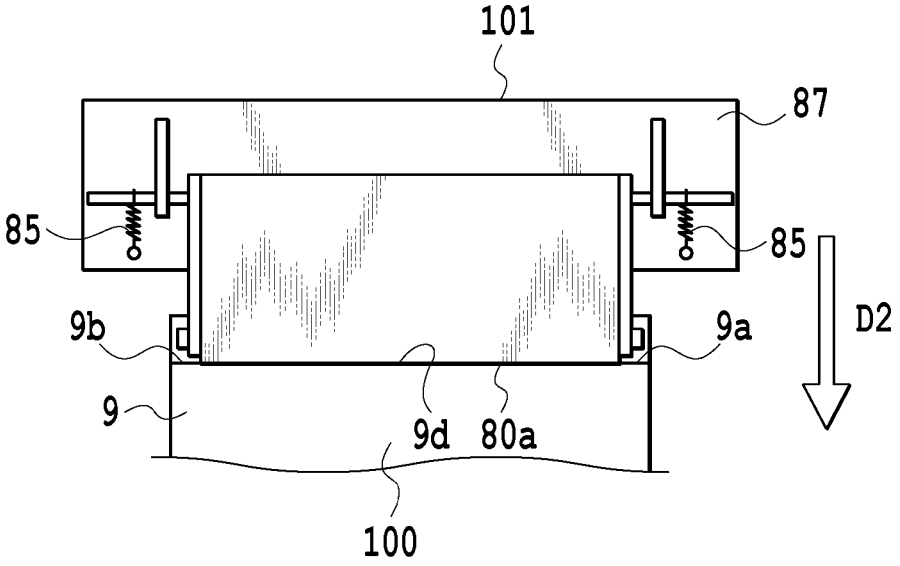
FIG. 12B is a top view illustrating the printer and the stack device at the time of being connected to each other.

The urging spring 85 is a tension spring having initial tension that has twice a force necessary for sliding the sheet feeding part unit 89, and has the tension enough for urging the sheet feeding part unit 89 in the insert direction of the stack device (direction of arrow D2). It should be noted that when the tension of the urging spring 85 is made larger than necessary, there is a possibility of damaging the printer 100 at the time of connecting the stack device 101 and the printer 100. Therefore the tension of the urging spring 85 may be set appropriately in consideration of the urging force. FIG. 11 is a perspective view illustrating the printer 100 and the stack device 101 in a state before being connected to each other. FIG. 12A and FIG. 12B are top views each illustrating the printer 100 and the stack device 101 at the time of being connected to each other.

Here, an explanation will be made of an operation of the sheet feeding part unit 89 at the time of connecting the printer 100 and the stack device 101. At the time of connecting the printer 100 and the stack device 101, the stack device 101 is moved toward the printer opening port 109 in the insert direction (direction of arrow D2) to be connected to the printer 100. Before being connected thereto, the sheet feeding part unit 89 is urged by the urging spring 85, while being in an initial state (initial posture) where the rotational shaft 82 is stopped in the end of the elongated hole of the sheet feeding part guide side plate 84. When the stack device 101 is connected to the printer 100 in this state, the striking part 80*a* of the sheet feeding part 80 is struck on a striking part 9*d* (sheet discharge part) of the printer 100. This striking moves the rotational shaft 82 that has been in one end of the elongated hole of the guide side plate 84 in a direction of the other end for the striking part 80*a* and the striking part 9*d* to be struck without a space, thus enabling good sheet conveyance in which jamming is difficult to occur.

In a case of the elongated printer such as a large-sized printer, since an error of precision in parts is enlarged, it is estimated that a deviation of approximately several mm in the conveyance direction D occurs between the right striking part 9*a* and the left striking part 9*b*. For example, it is estimated that a deviation of approximately 2 or 3 mm occurs in the printer having the length of 60 inches. This deviation causes the striking parts to be one side-struck on one end to create a space of approximately 2 or 3 mm, so that the sheet end is engaged, creating a possibility that the sheet cannot be conveyed. In the present embodiment, even in that case, the excellent connection between the printer and the stack device is made possible. Hereinafter, the configuration will be explained.

Figure 13A:
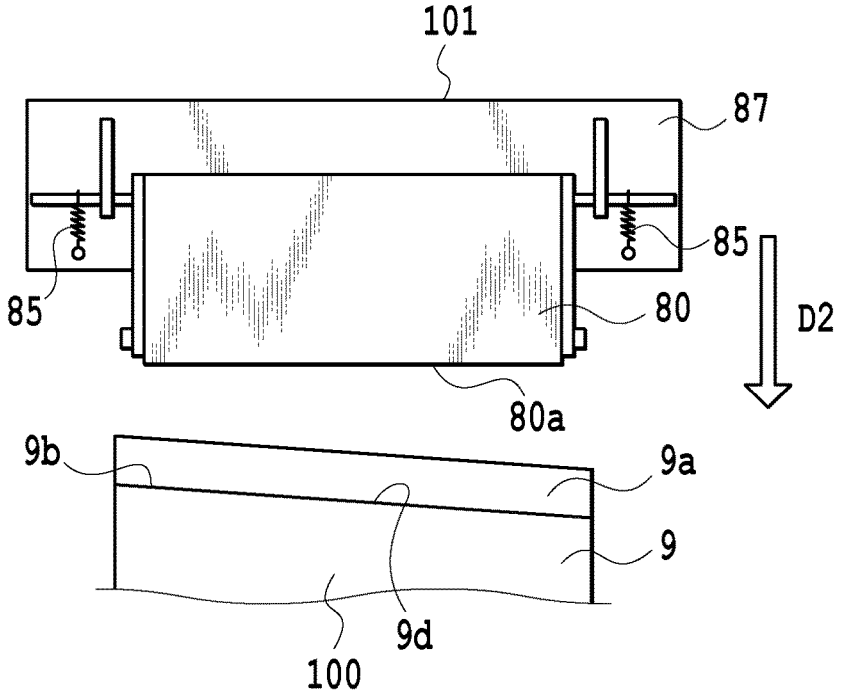
FIG. 13A is a top view illustrating a state between the printer and the stack device.
Figure 13B:
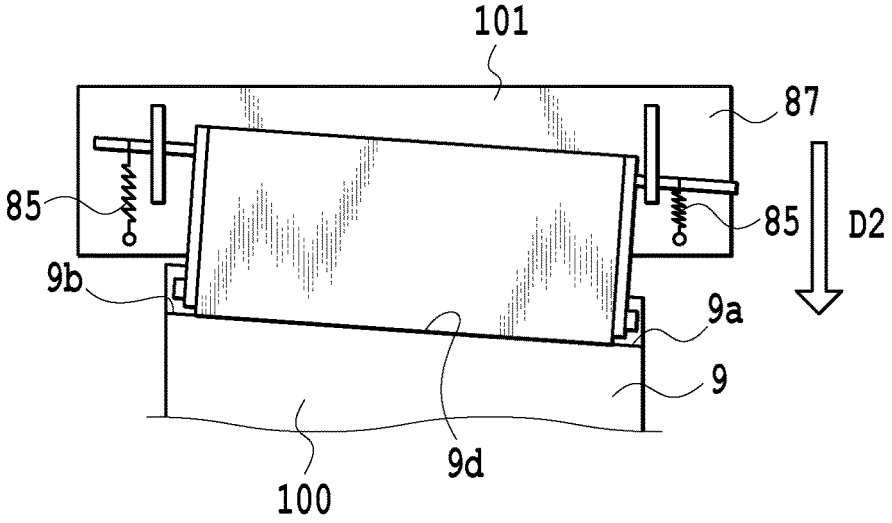
FIG. 13B is a top view illustrating a state between the printer and the stack device.

FIG. 13A is a top view illustrating a state before connecting the printer 100 and the stack device 101 in which a deviation occurs between the right striking part 9*a* and the left striking part 9*b*, and FIG. 13B is a top view illustrating a state after the printer 100 and the stack device 101 in FIG. 13A are connected. At the connecting time, when the stack device 101 is pushed into the printer 100, first, one end of the sheet feeding part unit 89 abuts on the left striking part 9*b*.

In addition, when the stack device 101 is further pushed into the printer 100, the other end of the sheet feeding part unit 89 abuts on the right striking part 9*a* in the printer 100. Since the one end of the sheet feeding part unit 89 first struck on the left striking part 9*b* is urged by the urging spring 85, the one end of the sheet feeding part unit 89 is connected to the left striking part 9*b* without creating a space until the other end strikes on the right striking part 9*a*. Since the rotational shaft 82 of the sheet feeding part unit 89 is supported by the elongated hole, as illustrated in FIG. 13B the sheet feeding part unit 89 abuts along the striking part 9*b* (sheet discharge port) in a state having an inclination from the left to the right. When the connected stack device 101 is separated from the printer 100 for the both to be disconnected, the sheet feeding part unit 89 is returned back to an original initial state (initial posture) by the force of the urging spring 85.

Here, assuming that the sheet feeding part unit 89 does not have a flexible support structure of sliding independently to the right and left, at the time one end of the sheet feeding part unit 89 strikes on the sheet discharge guide, the striking part of the sheet feeding part possibly damages the striking part of the sheet discharge guide. In a case of forming the sheet feeding part unit 89 with the flexible support structure as in the case of the present embodiment, there is the less possibility of damaging the striking part of the sheet discharge guide. Even if any of the right striking part 9*a* and the left striking part 9*b* strikes ahead on the sheet feeding part unit 89, the similar effect can be obtained regardless of the striking order.

Previously, the description is made of the effect to the deviation between the right and left ends of the striking part of the sheet feeding part at the time of connecting the stack device 101 and the printer 100. Hereinafter, an explanation will be made of the effect to the deviation in the height direction.

Figure 14A:
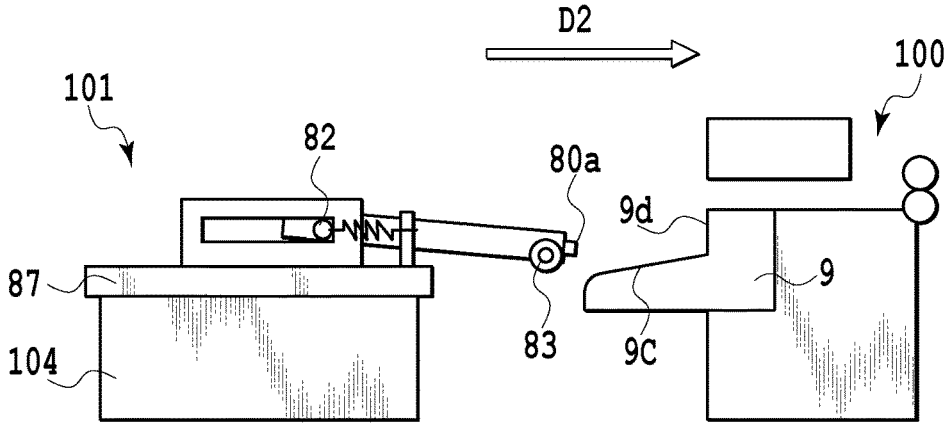
FIG. 14A is aside view illustrating a striking part of each of the stack device and the printer.
Figure 14B:
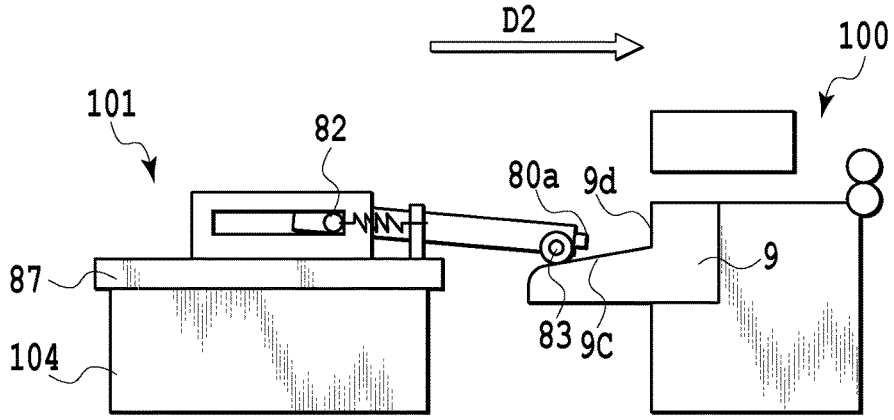
FIG. 14B is a side view illustrating the striking part of each of the stack device and the printer.
Figure 14C:
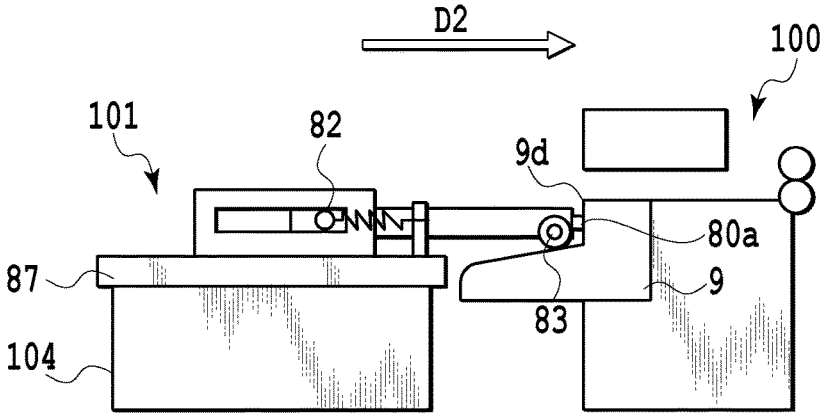
FIG. 14C is a side view illustrating the striking part of each of the stack device and the printer.

FIG. 14A to FIG. 14C are side views each illustrating the striking part at the time of connecting the stack device 101 and the printer 100. When the stack device 101 is further pushed to the printer 100-side from an initial state in FIG. 14A, as illustrated in FIG. 14B the rollers 83 in both the ends of the sheet feeding part unit 89 ride on a sheet discharge guide inclination part 9*c*. Since the sheet feeding part unit 89 is flexibly rotatable on a basis of the rotational shaft 82 at this time, the sheet feeding part unit 89 rotates along the inclination of the sheet discharge guide inclination part 9*c*. When the stack device 101 is further pushed to the printer 100-side from a state in FIG. 14B, as illustrated in FIG. 14C the striking part of the stack device 101 strikes on the striking part of the sheet discharge guide. At this time also, the sheet feeding part unit 89 rotates along the sheet discharge guide inclination part 9*c*, and therefore the striking part of the sheet feeding part strikes on the striking part of the sheet discharge guide. When the connected stack device 101 is separated from the printer 100 to disconnect both of them, the sheet feeding part unit 89 returns back to the original initial state by the self-weight (FIG. 14A).

Here, there is assumed that the sheet feeding part unit 89 is formed not of the support structure of being flexibly rotatable, but of the rigid support structure. In this assumption mode, in a state where the rollers 83 strike on the sheet discharge guide inclination part 9*c*, there is a possibility that the stack device 101 cannot be pushed into the printer 100-side. In this case, the striking part 80*a* of the sheet feeding part does not strike on the striking part of the sheet discharge guide, producing a space in the conveying route of the sheet between the stack device 101 and the printer 100 to create sheet jamming and sheet break. As a result, there is a possibility that good sheet conveyance cannot be performed.

As in the case of the present embodiment, the striking part of the stack device and the striking part of the printer can strike with each other by forming the sheet feeding part unit 89 with the support structure of being flexibly rotatable, having no possibility of producing the space in the sheet conveyance route.

Next, an explanation will be made of a case where there is a difference in height between both the right and left ends of the sheet discharge guide 9. In this case, there occurs a deviation in the height direction in any of the right and left sides of the striking parts of the stack device 101 and the printer 100, and the striking parts do not strike with each other in the end where the deviation occurs, possibly creating a space in the height direction. Therefore the sheet feeding part 80 as a plate member is made of low rigidity such that the sheet feeding part 80 is flexibly twisted to follow the space. By forming the sheet feeding part 80 with the low rigidity in such a manner as to be flexibly deformed to the heights of the sheet discharge guide 9 in both the right and left ends to follow the sheet discharge guide 9, even in a case where there is a difference in height between the right and left of the sheet discharge guide 9, the connection without the space between the stack device 101 and the printer 100 is made possible, making it possible to provide the good sheet conveyance. A material of the sheet feeding part 80 is optionally made of aluminum having a thin plate thickness (t=1.5 mm), for example, to have rigidity of following the right and left heights of the sheet discharge guide 9.

The structure as described above is made in a combination with the structure that the stack device 101 rides up the printer 100, but by using the structure of the sheet feeding part unit 89 in the stack device alone, it is possible to absorb variations in the striking parts of the stack device 101 and the printer 100 for excellent connection of both.

In this way, there is provided the receiving member that supports the sheet on the conveying surface at the delivery time, is provided with a butting part that abuts on the printer, and extends in the delivery direction of the sheet. The receiving member is provided to be movable in the conveying direction of the sheet, rotatable within the conveying plane, and rotatable around the shaft in a direction crossing the conveying direction within the conveying plane on a base end of the receiving member. That is, the receiving member is provided in the receiving port of the stack device, and at the time of connecting the stack device and the printer, the receiving member is flexibly displaced or is deformed along the sheet discharge port of the printer. As a result, it is possible to perform the excellent delivery of the sheet between the stack device 101 and the printer 100.

Figure 15:
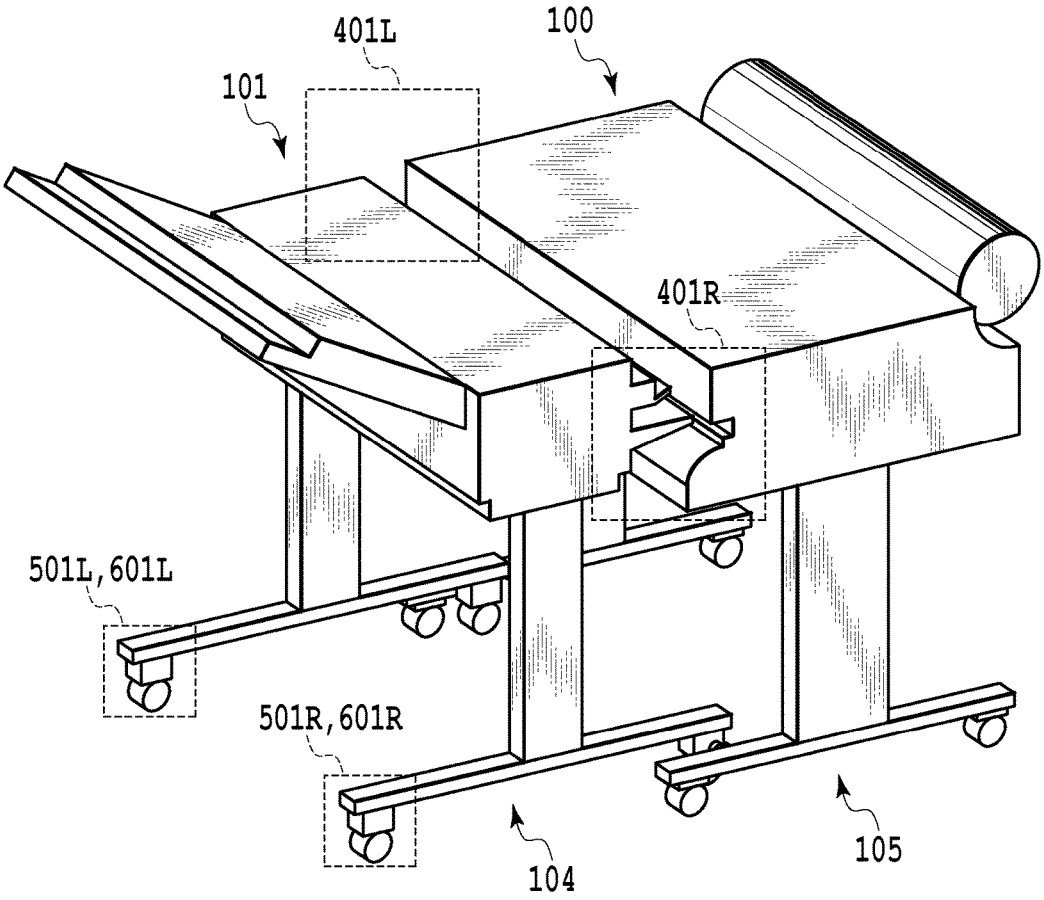
FIG. 15 is a perspective view illustrating the connected printer and stack device.
Figure 16A:
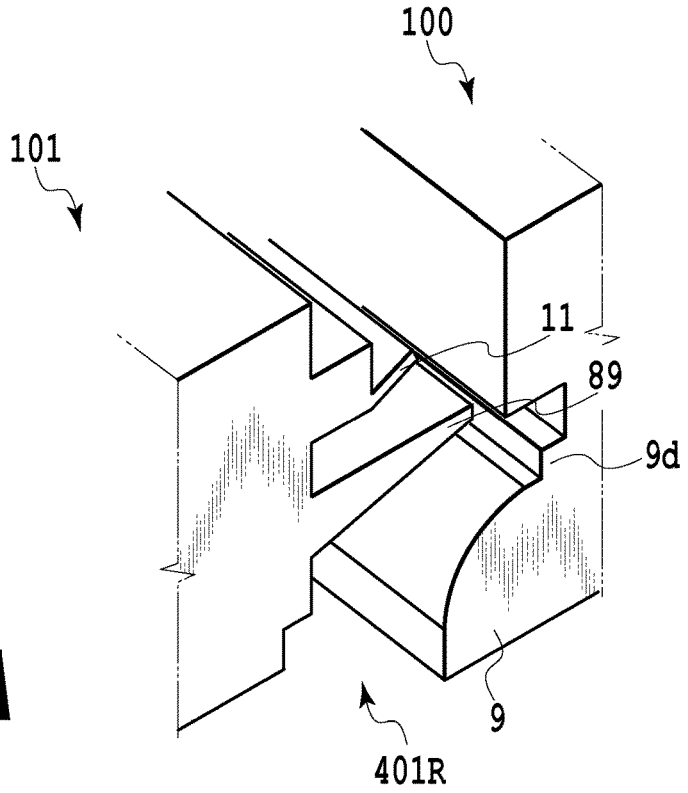
FIG. 16A is a diagram illustrating a position identifying part between the stack device and the printer.
Figure 16B:
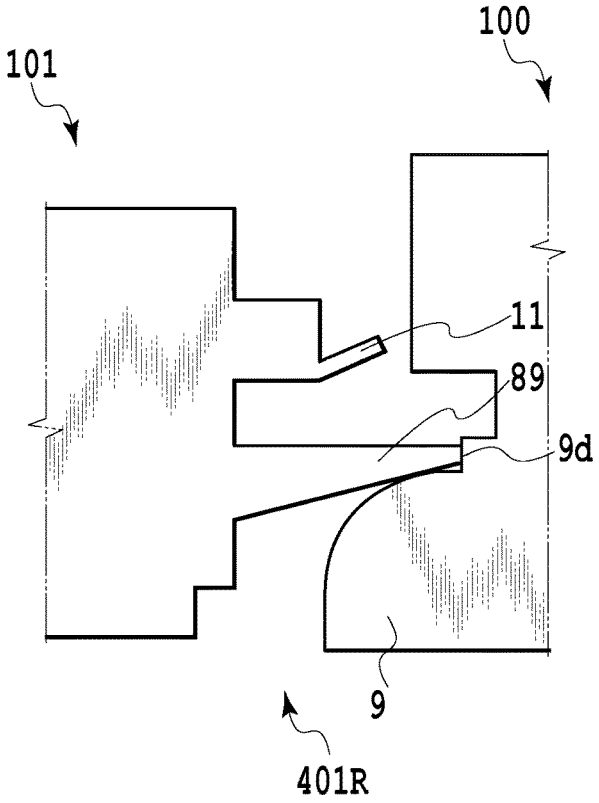
FIG. 16B is a diagram illustrating the position identifying part between the stack device and the printer.
Figure 17C:
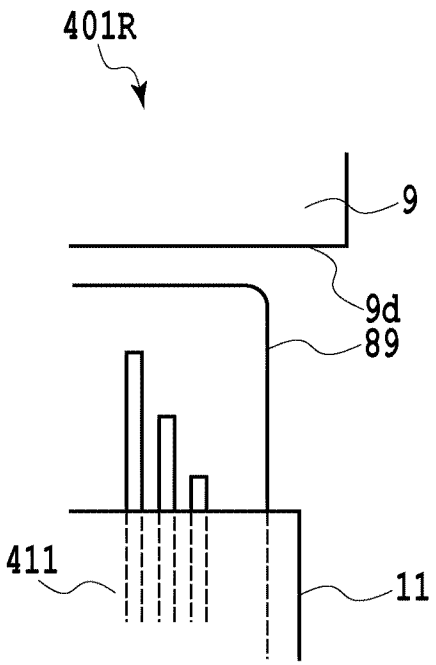
FIG. 17C is a top view illustrating the position identifying part for each state between the stack device and the printer.
Figure 17B:
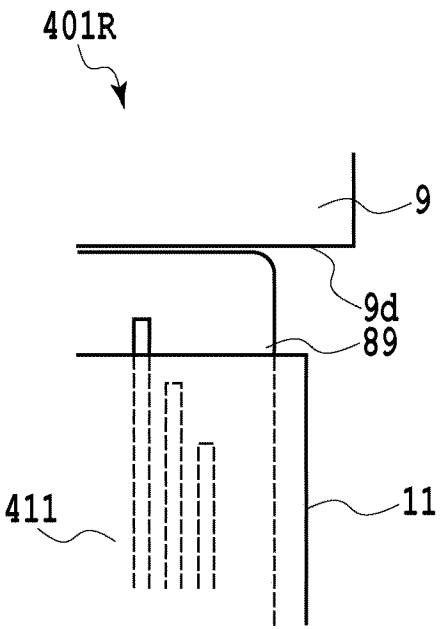
FIG. 17B is a top view illustrating the position identifying part for each state between the stack device and the printer.
Figure 17A:
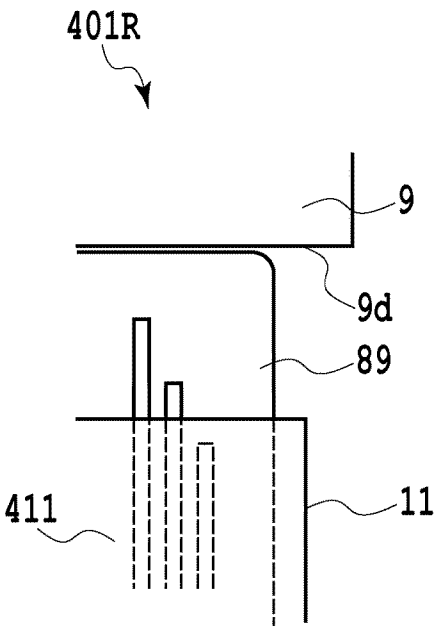
FIG. 17A is a top view illustrating the position identifying part for each state between the stack device and the printer.

FIG. 15 is a perspective view illustrating the connected printer 100 and stack device 101. FIG. 16A and FIG. 16B are diagrams each illustrating a position identifying part 401 between the stack device 101 and the printer 100. FIG. 17A to FIG. 17C are top views each illustrating the position identifying part for each state between the stack device 101 and the printer 100. FIG. 17A is a diagram illustrating a state where a positional relation in the conveying direction between the stack device 101 and the printer 100 is appropriate and therefore the adjustment therebetween is not needed. FIG. 17B and FIG. 17C are diagrams each illustrating a state where the positional relation in the conveying direction between the stack device 101 and the printer 100 is largely deviated and therefore the adjustment therebetween is needed. Hereinafter, an explanation will be made of the structure of the position identifying means and each state.

Position identifying parts 401L and 401R are provided in both ends of the printer 100 and the stack device 101. Each of the position identifying parts 401L and 401R is provided with the sheet discharge guide 9 in the printer 100, a striking surface 9A of the sheet discharge guide 9, the sheet feeding part unit 89 that can swing in the conveying direction of the stack device 101, and a fixed joint upper guide 11. With the confirmation by the position identifying parts 401L and 401R, it is possible to confirm whether or not a position of the stack device 101 to the printer 100 is correct.

When the stack device 101 is connected to the printer 100, as illustrated in FIG. 7 the roller 63 in the stack device 101-side rides up the roller receiving board 113 of the printer 100-side. Therefore the height of the opening port 108 can be made substantially equal to the height of the opening port 109 regardless of the unevenness of the floor. The position where the roller 63 rides up the roller receiving board 113 is right under the sheet delivery part. Therefore even if the stack device installing floor has more or less unevenness and the stack device 101 itself rotates around the riding-on position, a state where the respective sheet delivery parts are substantially in agreement in height can be maintained.

However, a position in the conveying direction in a relative positional relation between the opening port 108 of the stack device and the opening port 109 of the printer tends to be easily influenced by the uneven state of the floor. When the floor where the stack device is installed has the unevenness to the printer installing floor, the stack device rotates around the roller 63 that has ridden on the roller receiving board 113. Thereby the opening port 108 is deviated (separated) in position of the conveying direction from the printer opening port 109.

The positional relation between the printer 100 and the stack device 101 has three states. When the printer 100 and the stack device 101 are typically connected on a substantially planar floor, the movable sheet feeding part unit 89 strikes on the striking part 9*d* of the sheet feeding guide, creating a state where there is no space between the sheet feeding part unit 89 and the striking part 9*d*. This state is a state illustrated in FIG. 17A, where two of three position identifying lines 411 provided on the surface of the sheet feeding part unit 89 are visual. In this state, the delivery of the sheet can be performed with accuracy in the height direction and in the conveying direction.

In addition, in a case where the floor where the stack device 101 is installed has a large convex part, the stack device 101 rotates around the roller 63 in a direction of narrowing the space between the opening port 108 and the printer opening port 109. Further, the sheet feeding part unit 89 moves beyond a movable range to strike on the striking part 9*d*. If this state lasts long, there is a possibility of being broken. This state is illustrated in FIG. 17B, where the single position identifying line 411 is visual.

In addition, in a case where the floor where the stack device 101 is installed has a large concave part, the stack device 101 rotates around the roller 63 in a direction of widening the space between the opening port 108 and the printer opening port 109. In this case, the sheet feeding part unit 89 does not strike on the striking part 9*d* to produce a space therebetween. If the curled sheet is conveyed in this state, a sheet tip enters into the space to cause sheet jamming. This state is a state illustrated in FIG. 17C, where three position identifying lines 411 are visual. In a case of the states illustrated in FIG. 17B and FIG. 17C, since there is a high possibility of device break and jamming occurrence, the position adjustment is required as soon as possible.

Figure 18:
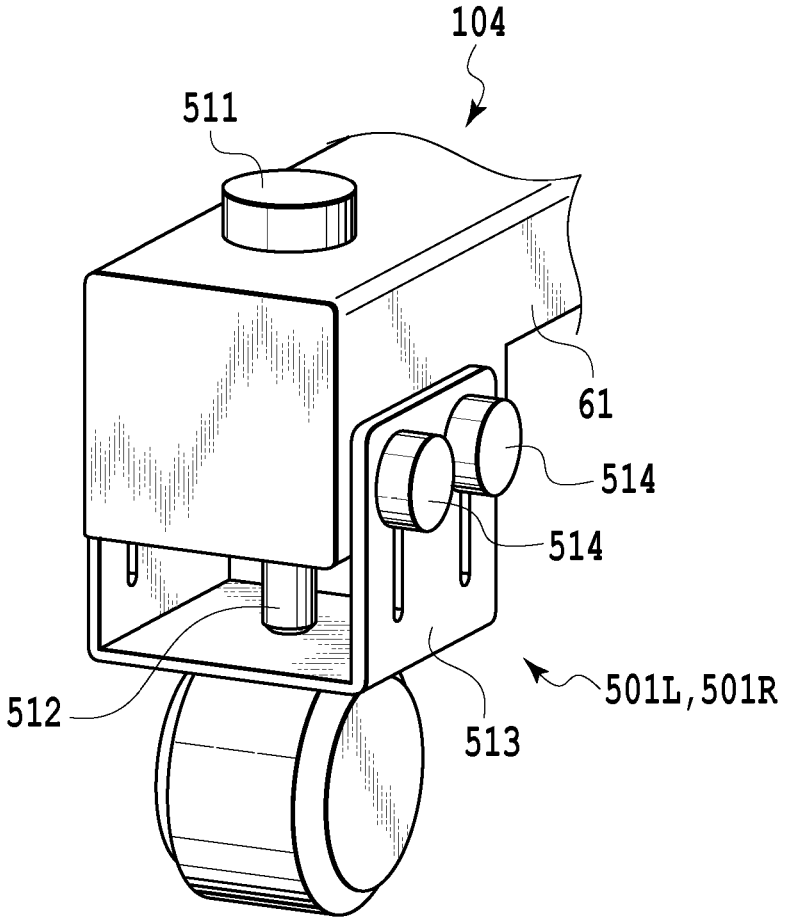
FIG. 18 is a perspective view illustrating a position adjusting part of a stand unit in the stack device.
Figure 19C:
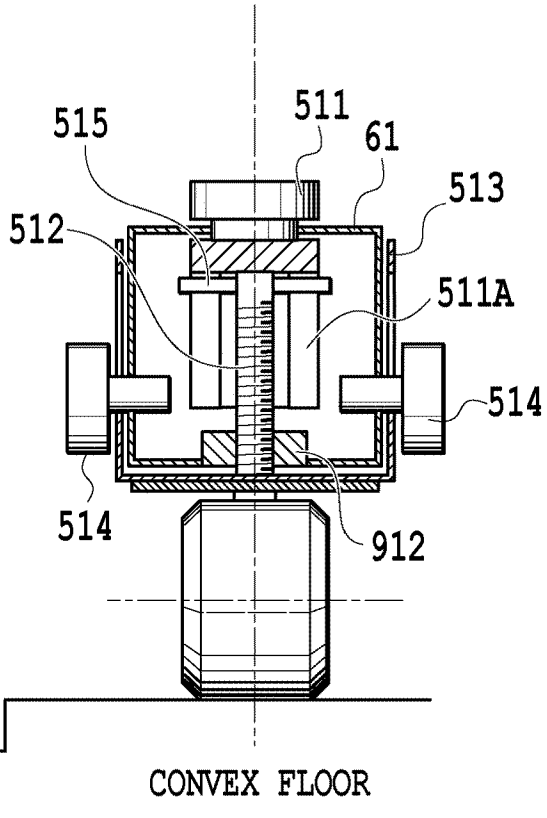
FIG. 19C is a sectional view illustrating the position adjusting part of the stand unit.
Figure 19B:
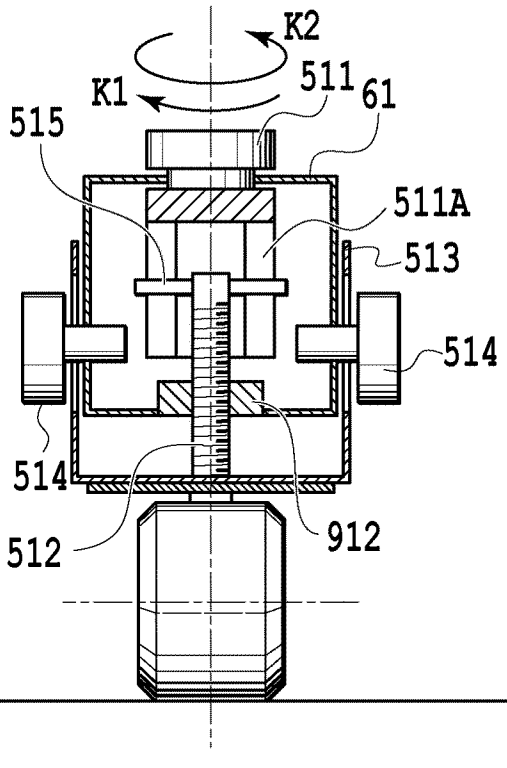
FIG. 19B is a sectional view illustrating the position adjusting part of the stand unit.
Figure 19A:
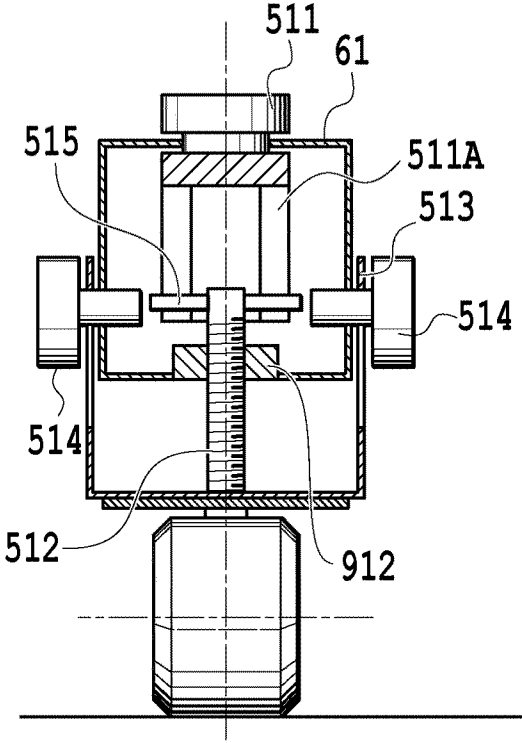
FIG. 19A is a sectional view illustrating the position adjusting part of the stand unit.

FIG. 18 is a perspective view illustrating a position adjusting part 501R of the stand unit 104 in the stack device 101. FIG. 19A to FIG. 19C are sectional views each illustrating the position adjusting part 501R and diagrams illustrating upper limit, intermediate, and lower limit states of the adjustment range. Hereinafter, the structure and operation of the position adjusting means will be explained with reference to FIG. 15, FIG. 18, and FIG. 19A to FIG. 19C.

The position adjusting parts 501L, 501R as the position adjusting means are provided in two locations in both ends of the stand unit 104. Since the position adjusting parts 501L, 501R have the same structure, herein the position adjusting part 501R is used for explanation. The position adjusting part 501R is structured such that the height of the foot part 61 to an adjusting plate 513 can change with rotation of an adjusting bolt 512. At the height adjusting time, when an adjusting knob 511 is rotated, this rotation is transmitted through a pin 515 press-fitted in the adjusting bolt 512 to the adjusting bolt 512 (refer to FIG. 19A to FIG. 19C). When the adjusting bolt 512 is rotated, the foot part 61 moves up and down by a nut 912 fixed on the foot part 61.

When the adjusting knob 511 is rotated in a direction of arrow K1 from the state in FIG. 19B, the foot part 61 is pushed up in an upper direction to produce a state in FIG. 19A, thus making it possible to deal with the concave floor. On the other hand, when the adjusting knob 511 is rotated in a direction of arrow K2, the foot part 61 lowers down to produce a state in FIG. 19C to be capable of appropriately dealing with the height adjustment to the convex floor.

In this way, in a case where the state of the floor in the installing position is formed to be more convex than a substantially planar face, the adjusting knob 511 rotates in the K1 direction, and in reverse, in a case where the state of the floor in the installing position is formed to be more concave, when the adjusting knob 511 is rotated in a direction of arrow K2, the height adjustment of the foot part 61 is made possible even in the largely uneven floor (the details will be described later).

Figure 20:
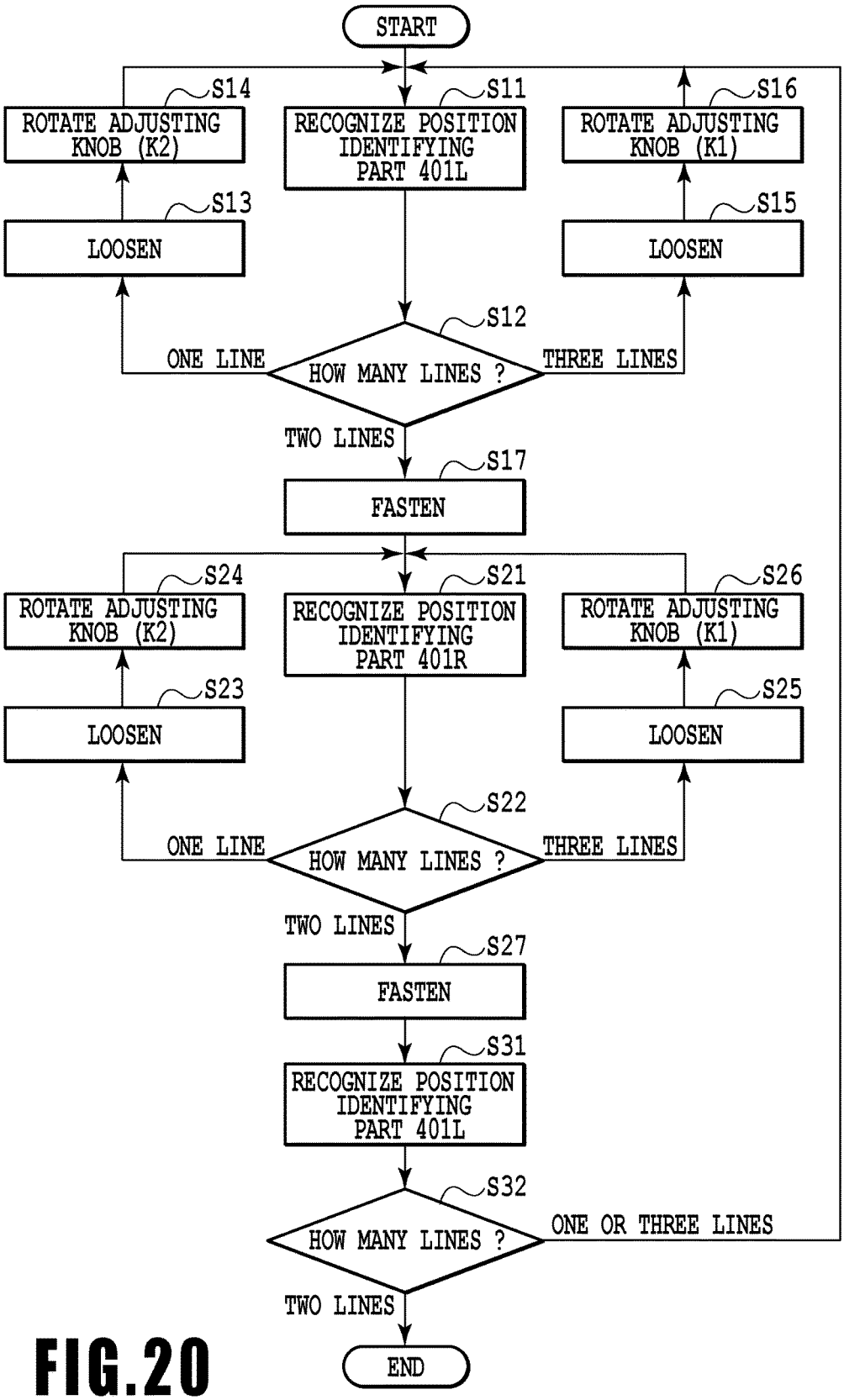
FIG. 20 is a flow chart illustrating a series of processes for performing a height adjustment of the stack device.
Figure 21:
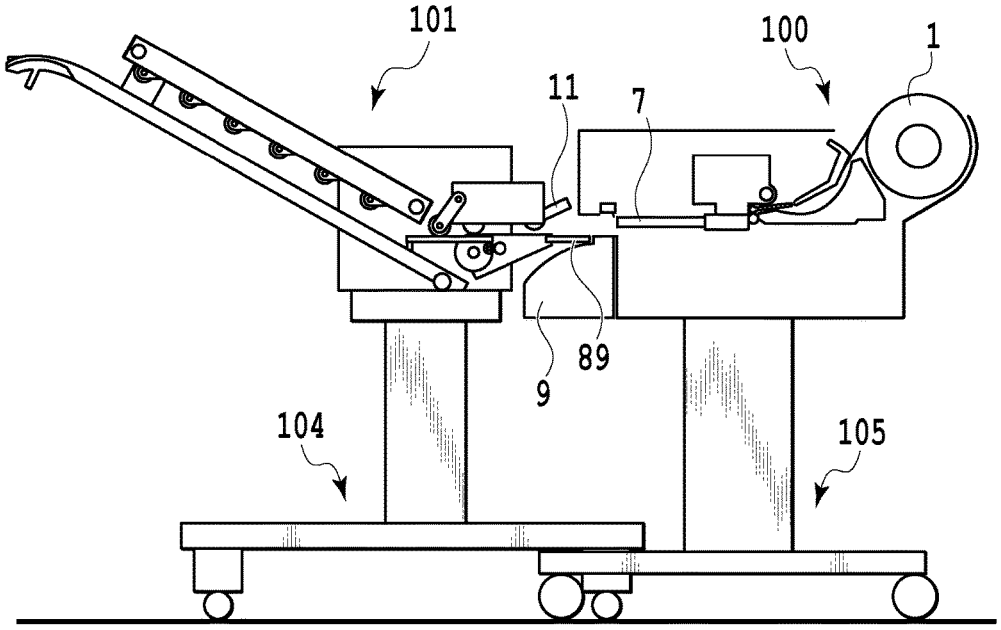
FIG. 21 is aside sectional view illustrating a state where the stack device is connected to the printer.
Figure 22A:
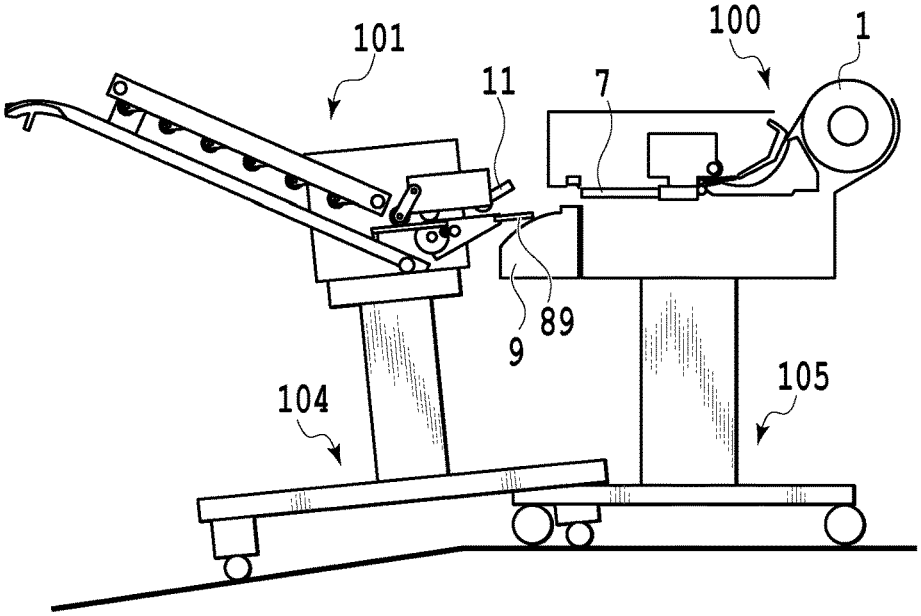
FIG. 22A is a diagram illustrating a state where the stack device is connected to the printer.
Figure 22B:
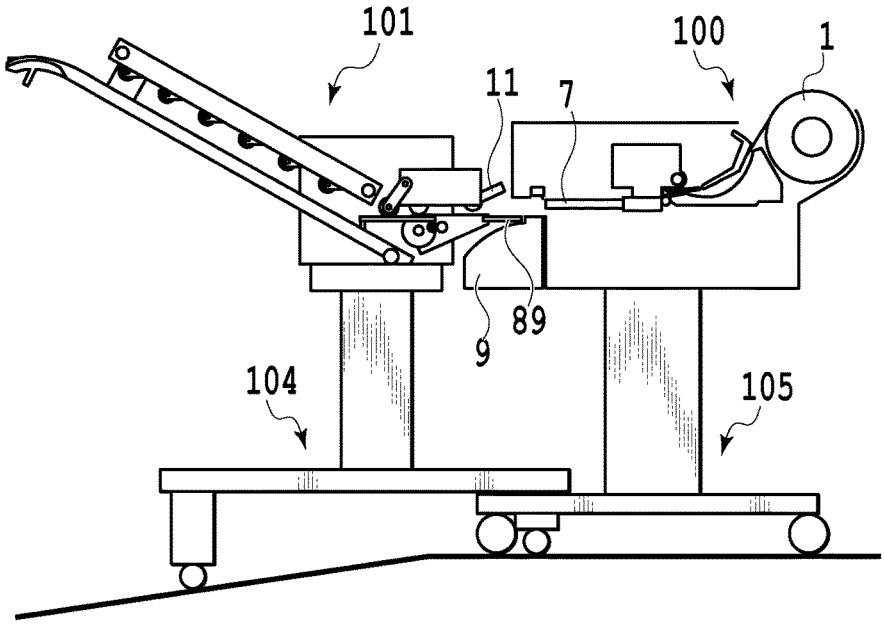
FIG. 22B is a diagram illustrating a state where the stack device is connected to the printer.
Figure 23A:
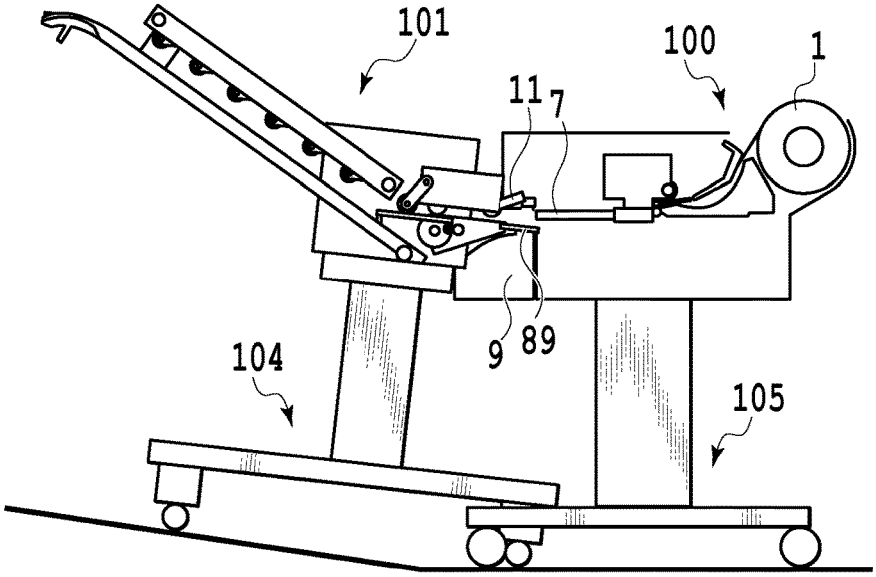
FIG. 23A is a diagram illustrating a state where the stack device is connected to the printer.
Figure 23B:
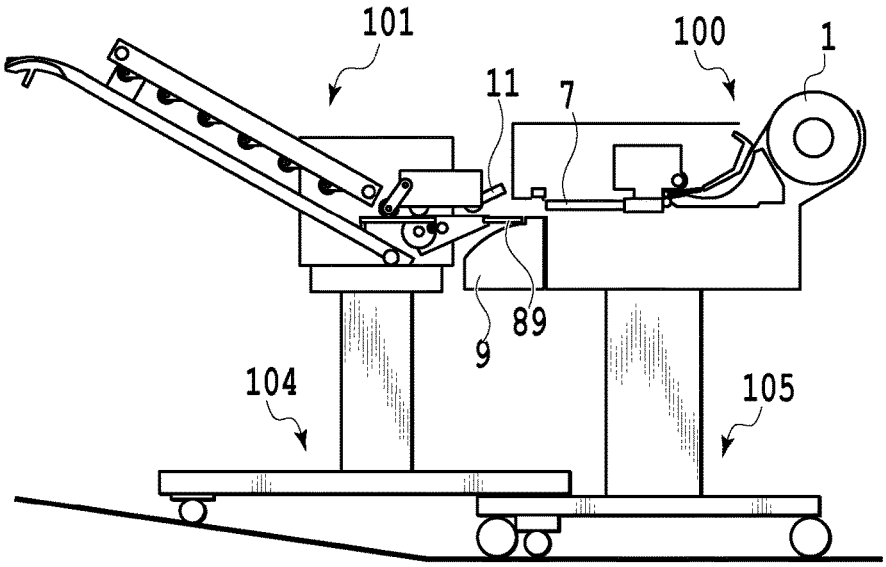
FIG. 23B is a diagram illustrating a state where the stack device is connected to the printer.

FIG. 20 is a flow chart illustrating a series of processes at the time of performing the height adjustment of the stack device. FIG. 21 is a side sectional view illustrating the stack device 101 and the printer 100 in the connecting state on the planar floor. FIG. 22A and FIG. 22B are side sectional views each illustrating the stack device 101 and the printer 100 in the connecting state in a case where the floor on which the stack device is installed is formed to be concave. FIG. 23A and FIG. 23B are side sectional views each illustrating the stack device 101 and the printer 100 in the connecting state in a case where the floor on which the stack device is installed is formed to be convex.

Hereinafter, an explanation will be made of a specific method for adjusting the positional relation between the printer 100 and the stack device 101.

As illustrated in FIG. 21, at the time of installing the printer 100 and the stack device 101 on the planar floor, the connection can be made in a state where the sheet feeding part unit 89 appropriately strikes on the striking part 9*d* of the sheet discharge guide 9 in the printer without performing the adjustment particularly.

As illustrated in FIG. 22A and FIG. 22B, in a case where the floor on which the stack device is installed has a concave surface, as illustrated in FIG. 22A the stack device 101 is inclined and connected to the printer 100 in such a manner as to lower the forward side of the sheet in the discharge direction before adjustment. The excellent connecting state as illustrated in FIG. 22B can be obtained by performing the height adjustment from a state in FIG. 22A.

As illustrated in FIG. 23A and FIG. 23B, in a case where the floor on which the stack device is installed has a convex surface, as illustrated in FIG. 23A the stack device 101 is inclined and connected to the printer 100 in such a manner as to raise the forward side of the sheet in the discharge direction before adjustment. The excellent connecting state as illustrated in FIG. 23B can be obtained by performing the height adjustment from a state in FIG. 23A.

Hereinafter, an explanation will be made of a series of processes at the time of performing the height adjustment with reference to the flow chart in FIG. 20.

First, at step S11 the position identifying part 401L that can determine whether or not a positional relation between the printer 100 and the stack device 101 at the left end is appropriate is viewed by visual contact from above to confirm the position identifying line 411 on the sheet feeding part unit 89. After that, at step S12 it is determined how many position identifying lines 411 are present thereon. In a case of the two position identifying lines 411 (case in FIG. 17A), it is determined that the installing floor of the stack device 101 is formed of a substantially planar face and the positional relation between the printer 100 and the stack device 101 is appropriate, and the process goes to step S17. In a case of the single position identifying line 411 (case in FIG. 17B), it is determined that the installing floor of the stack device 101 is formed of a convex face and the positional relation between the printer 100 and the stack device 101 is defective, and the process goes to step S13.

At step S13 a fixed knob 514 is loosened and at step S14 the adjusting knob 511 is rotated in the K2 direction, and the process goes back to step 11. At step 12 in a case of the three position identifying lines 411 (case in FIG. 17C), it is determined that the installing floor of the stack device 101 is formed of a convex face and the positional relation between the printer 100 and the stack device 101 is defective, and the process goes to step S15. At step S15 the fixed knob 514 is loosened and at step S16 the adjusting knob 511 is rotated in the K1 direction, and the process goes back to step 11. When the process transfers from step S12 to step S17, at step S17 the fixed knob 514 is fastened to complete the left adjustment.

After that, at step S21 the position identifying part 401R that can determine whether or not a positional relation between the printer 100 and the stack device 101 at the right end is appropriate is viewed by visual contact from above to confirm the position identifying line 411 on the sheet feeding part unit 89. After that, at step S22 it is determined how many position identifying lines 411 are present thereon. In a case of the two position identifying lines 411, it is determined that the installing floor of the stack device 101 is formed of a substantially planar face and the positional relation between the printer 100 and the stack device 101 is appropriate, and the process goes to step S27. In a case of the single position identifying line 411, it is determined that the installing floor of the stack device 101 is formed of a convex face and the positional relation between the printer 100 and the stack device 101 is defective, and the process goes to step S23.

At step S23 the fixed knob 514 is loosened and at step S24 the adjusting knob 511 is rotated in the K2 direction, and the process goes back to step 21. At step 22 in a case of the three position identifying lines 411, it is determined that the installing floor of the stack device 101 is formed of a convex face and the positional relation between the printer 100 and the stack device 101 is defective, and the process goes to step S25. At step S25 the fixed knob 514 is loosened and at step S26 the adjusting knob 511 is rotated in the K1 direction, and the process goes back to step 21. When the process transfers from step S22 to step S27, at step S27 the fixed knob 514 is fastened to complete the right adjustment.

After that, at step S31 the position identifying part 401L is again viewed by visual contact from above, and at step S32 it is determined how many position identifying lines 411 are present thereon. In a case of the single or three position identifying lines 411, the process goes back to step S11, wherein the adjustment is again made. In a case of the two position identifying lines 411, it is determined that the positional relation between the printer 100 and the stack device 101 is appropriate, and the adjustment is completed.

The positional adjustment between the printer 100 and the stack device 101 is made by such a series of the processes. Thereby even if the printer 100 and the stack device 101 are installed on the floor having the largely uneven surface, the opening port in the sheet conveyance route in each of the printer and the stack device is kept in an appropriate state without being subjected to the influence of the unevenness of the floor. As a result, reliability of the sheet conveyance delivery can be enhanced.

It should be noted that the present invention can be applied not only to the stack device and the printer that are explained above but also to devices for dealing with sheets between devices such as a sheet feeding device, a creaser, a document reading device or the like. Further, the present invention can be widely applied to use for delivery of a work piece in various kinds of manufacturing devices.

Second Embodiment

Hereinafter, an explanation will be made of a second embodiment in the present invention with reference to the accompanying drawings. Since a basic structure of the second embodiment is the same as that of the first embodiment, hereinafter only a characteristic structure thereof will be explained.

Figure 24A:
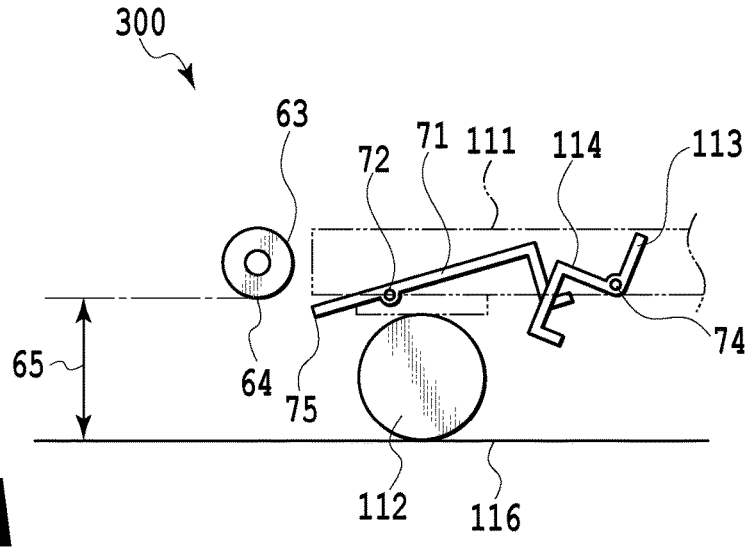
FIG. 24A is a diagram illustrating a stack device and a printer in a second embodiment of the present invention.
Figure 24B:
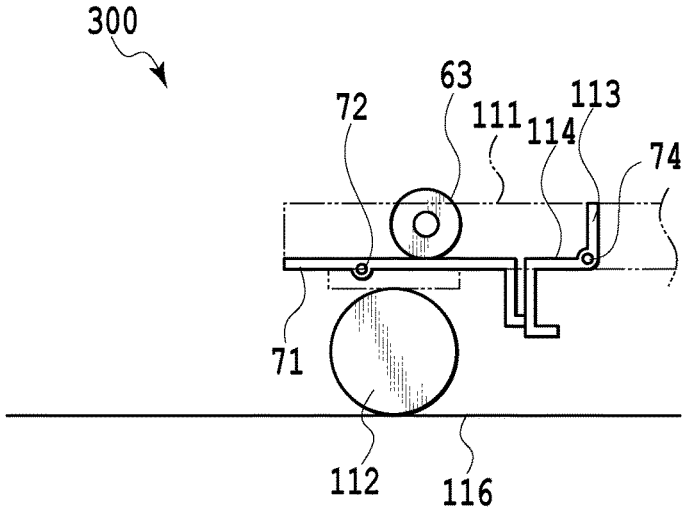
FIG. 24B is a diagram illustrating the stack device and the printer in the second embodiment.
Figure 24C:
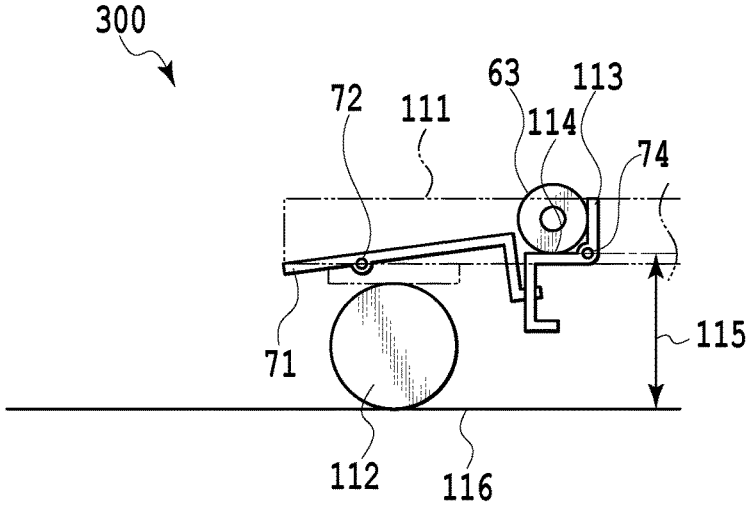
FIG. 24C is a diagram illustrating the stack device and the printer in the second embodiment.

FIG. 24A to FIG. 24C are side views each illustrating a roller 63 in a stack device 101 and a roller receiving board 113 in a printer 100. Hereinafter an explanation will be made of an operation that the roller 63 rides up the roller receiving board 113 at the time of connecting the stack device 101 and the printer 100.

FIG. 24A illustrates a state where the stack device is separated from the printer. FIG. 24B illustrates a state where the stack device is in close proximity to the printer. FIG. 24C illustrates a state where the stack device is connected to the printer. A roller receiving part 300 is structured to prevent the connected stack device 101 from being separated therefrom.

The roller receiving part 300 is provided with a roller guide 71 and the roller receiving board 113, wherein the roller guide 71 is rotatable around a guide shaft 72 and the roller receiving board 113 is rotatable on a basis of a receiving board shaft 74. The roller guide 71 is urged in a counterclockwise direction by an unillustrated spring, and is kept in a state where a guide end 75 is lowered on a condition that the stack device 101 is not connected to the printer 100.

The roller receiving board 113 is urged in a counterclockwise direction by an unillustrated spring, and is, as illustrated in FIG. 24A, kept in a state where a roller receiving face 114 is inclined on a condition that the stack device 101 is not connected to the printer 100. The roller guide and the roller receiving board 113 are structured to coordinate with each other, wherein when the roller guide 71 rotates in a clockwise direction, the roller receiving board 113 rotates in a counterclockwise direction, and when the roller guide 71 rotates in a counterclockwise direction, the roller receiving board 113 rotates in a clockwise direction.

At the time of connecting the stack device 101 and the printer 100, the roller 63 comes close to the roller guide 71 according to the stack device 101 coming close to the printer 100, and the roller 63 abuts on the guide end 75 of the roller guide 71. At this time the guide end 75 is in a position low enough for the roller 63 to easily ride on the roller guide 71. When the roller 63 abuts on the guide end 75 of the roller guide 71 and the stack device 101 is further pushed into the printer 100, the roller 63 rides up the roller guide 71 together with rotation of the roller guide 71 in the clockwise direction.

When the roller 63 rides up the roller guide 71 and passes the guide shaft 72, the roller guide 71 starts to rotate in a clockwise direction, and when the riding-on face of the roller guide 71 becomes in a horizontal state, the roller guide 71 abuts on an unillustrated stopper to stop the rotation. When the roller receiving board 113 rotates in a counterclockwise direction together with the rotation of the roller guide 71 in a clockwise direction and the roller receiving face 114 becomes in a horizontal state, the roller receiving board 113 abuts on an unillustrated stopper to stop the rotation. At this time the riding-on face of the roller guide 71 is substantially flush with the roller receiving face 114 (refer to FIG. 24B).

When the stack device 101 is further pushed into the printer 100 from the state in FIG. 24B, the roller 63 transfers from the riding-on face of the roller guide 71 to the roller receiving face 114, and abuts on a roller receiving wall 119. At this time, the roller guide 71 is released from the roller 63 riding thereon, rotates in a counterclockwise direction, and goes back to an original state where the guide end 75 is lowered. As a result, a guide rear end 76 is raised up to realize the pulling-out preventive effect that the roller 63 has the difficulty of turning back.

Here, in a case where a height of a roller lowest point 64 from the floor 116 in FIG. 24A is indicated at roller height 65, and a height of the roller receiving face 114 from the floor 116 in FIG. 24C is indicated at receiving board height 115, a relation of roller height 65<receiving board height 115 is established. Therefore as similar to the first embodiment, the unillustrated caster is separated from the floor 116.

That is, the stack device becomes in state of being not subjected to the influence of the floor unevenness and capable of performing delivery of the sheet with accuracy. With this structure, naturally the roller 63 tends to be easily led to the roller receiving board 113, and the connecting state is stabilized.

In addition, as similar to the first embodiment, the present structure can also be widely applied to a case for dealing with sheets such as paper or the like between devices, such as a sheet feeding device, a creaser, a document reading device or the like.

It should be noted that the explanation is made of the structure that the roller receiving board 113 rotates, but the present invention is not limited thereto, but the structure that the roller receiving face 114 does not rotate while being kept in a horizontal state may be adopted.

Third Embodiment

Hereinafter, an explanation will be made of a third embodiment in the present invention with reference to the accompanying drawings. In the aforementioned embodiment, the explanation is made of the method in which the stack device is adjusted in position while the position of the foot part successively moves with rotation of the adjusting bolt in the position adjusting mechanism. In the present embodiment, an explanation will be made of an adjusting method using an adjusting cam.

Figure 25:
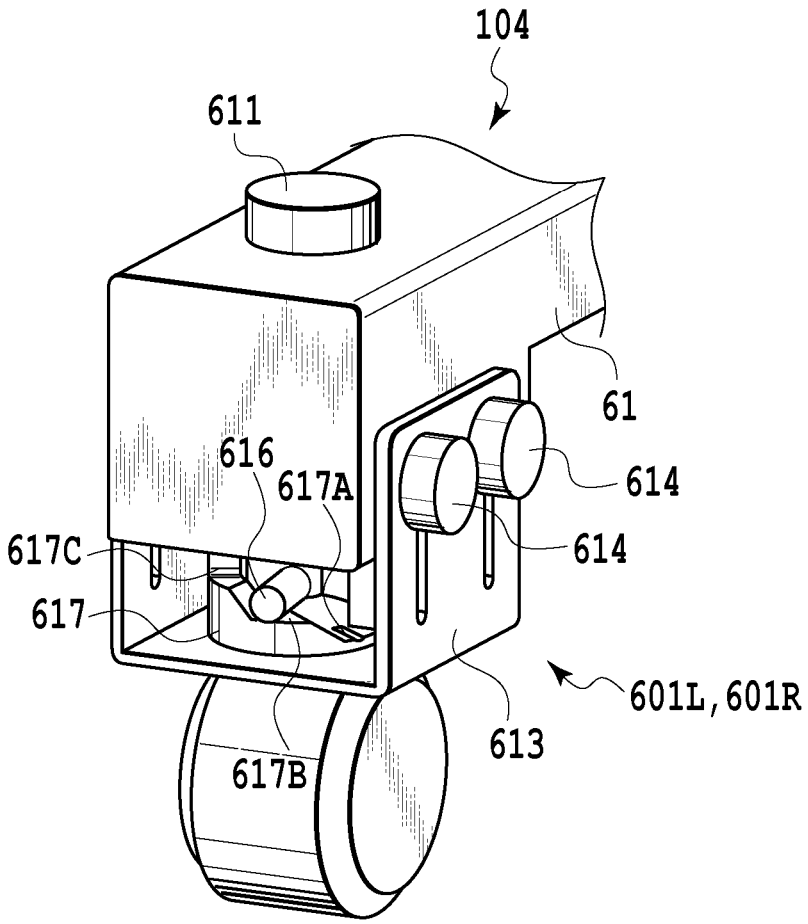
FIG. 25 is a perspective view illustrating a position adjusting part of a stand unit in a stack device in a third embodiment of the present invention.
Figures 26A, 26B, 26C:
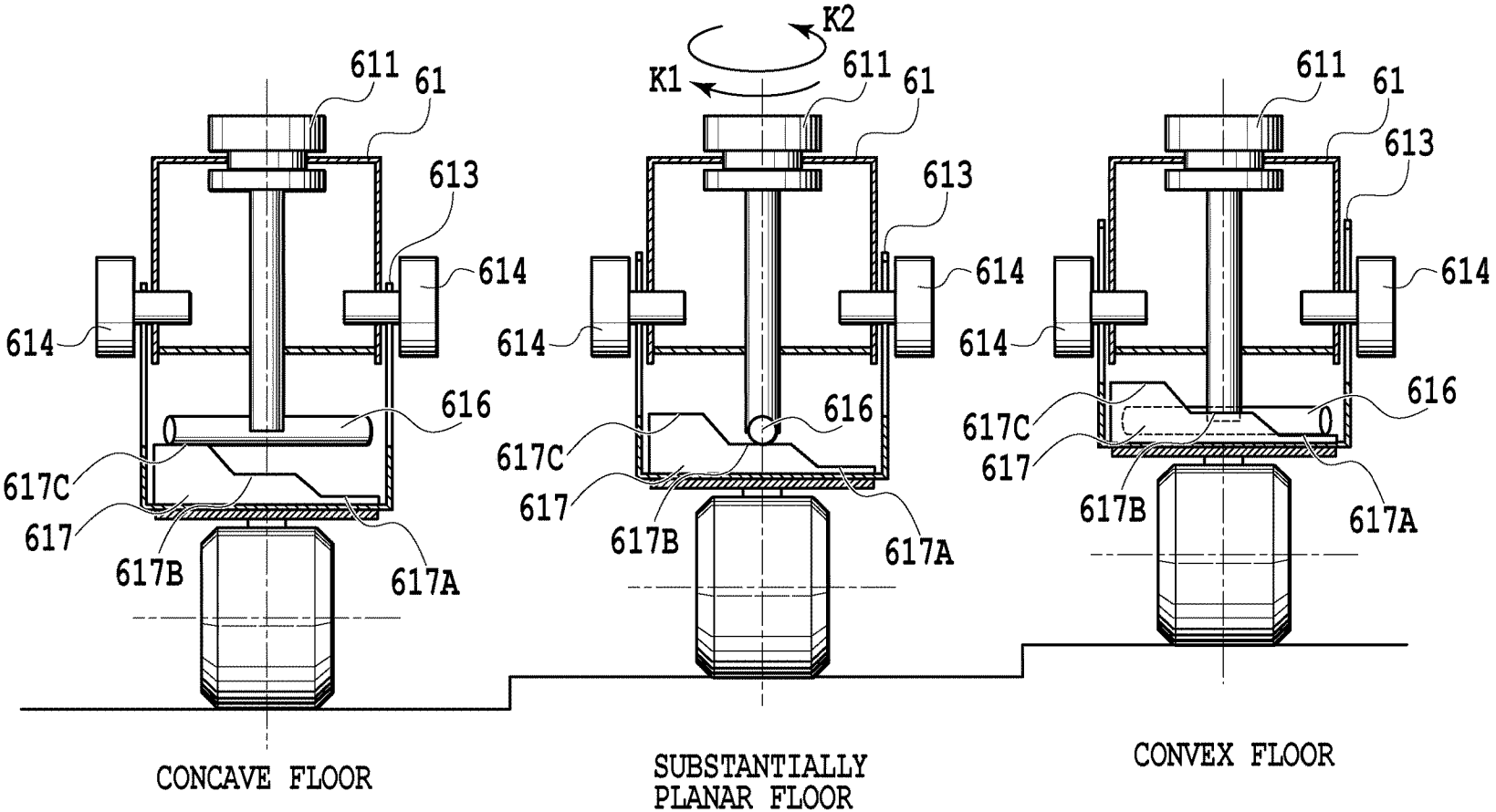
FIG. 26A is a sectional view illustrating the position adjusting part of the stand unit.
FIG. 26B is a sectional view illustrating the position adjusting part of the stand unit.
FIG. 26C is a sectional view illustrating the position adjusting part of the stand unit.

FIG. 25 is a perspective view illustrating a position adjusting part 601R of a stand unit 104. FIG. 26A to FIG. 26C are sectional views each illustrating the position adjusting part 601R. An adjusting pin 616 is provided in a lower part of an adjusting knob 611 rotatably attached to a foot part 61 in the stand unit 104. An adjusting cam 617 integral with an adjusting plate 613 has planar parts 617A, 617B, 617C that differ in height with each other. The adjusting pin 616 makes contact with a cam face of the adjusting cam 617, and the adjusting knob 611 is rotated to cause the cam face that will make contact with the adjusting pin 616 to differ, making it possible to adjust the height of the foot part 61 in three steps (plural steps).

When the adjusting knob 611 is rotated in a direction of arrow K1 from the state in FIG. 26B, the adjusting pin 616 climbs up on an inclination of the adjusting cam 617 to push up the foot part 61 to produce a state in FIG. 26A, thus making it possible to appropriately deal with the height adjustment to the concave floor. A groove is formed on a planar part 617C of the adjusting cam 617 on which the adjusting pin 616 has ridden, and after the height of the foot part 61 is adjusted, the adjusting pin 616 falls down therein to stabilize the position.

On the other hand, when the adjusting knob 611 is rotated in a direction of arrow K2, the adjusting pin 616 climbs down on the inclination of the adjusting cam 617 to lower down the foot part 61 to change the adjustment step from FIG. 26B to FIG. 26C, thus making it possible to appropriately deal with the height adjustment to the convex floor. At this state, a groove is formed on a planar part 617A of the adjusting cam 617 on which the adjusting pin 616 has ridden, and after the height of the foot part 61 is adjusted, the adjusting pin 616 falls down therein to stabilize the position.

In this way, in a case where the state of the floor for installing the stack device is formed to be more concave than a substantially planar face, the adjusting knob 611 rotates in the K1 direction, and in reverse, in a case where the state of the floor is formed to be more convex, the adjusting knob 611 is rotated in a direction of arrow K2. Therefore the height adjustment of the foot part 61 is made possible even in the largely uneven floor.

Figure 27:
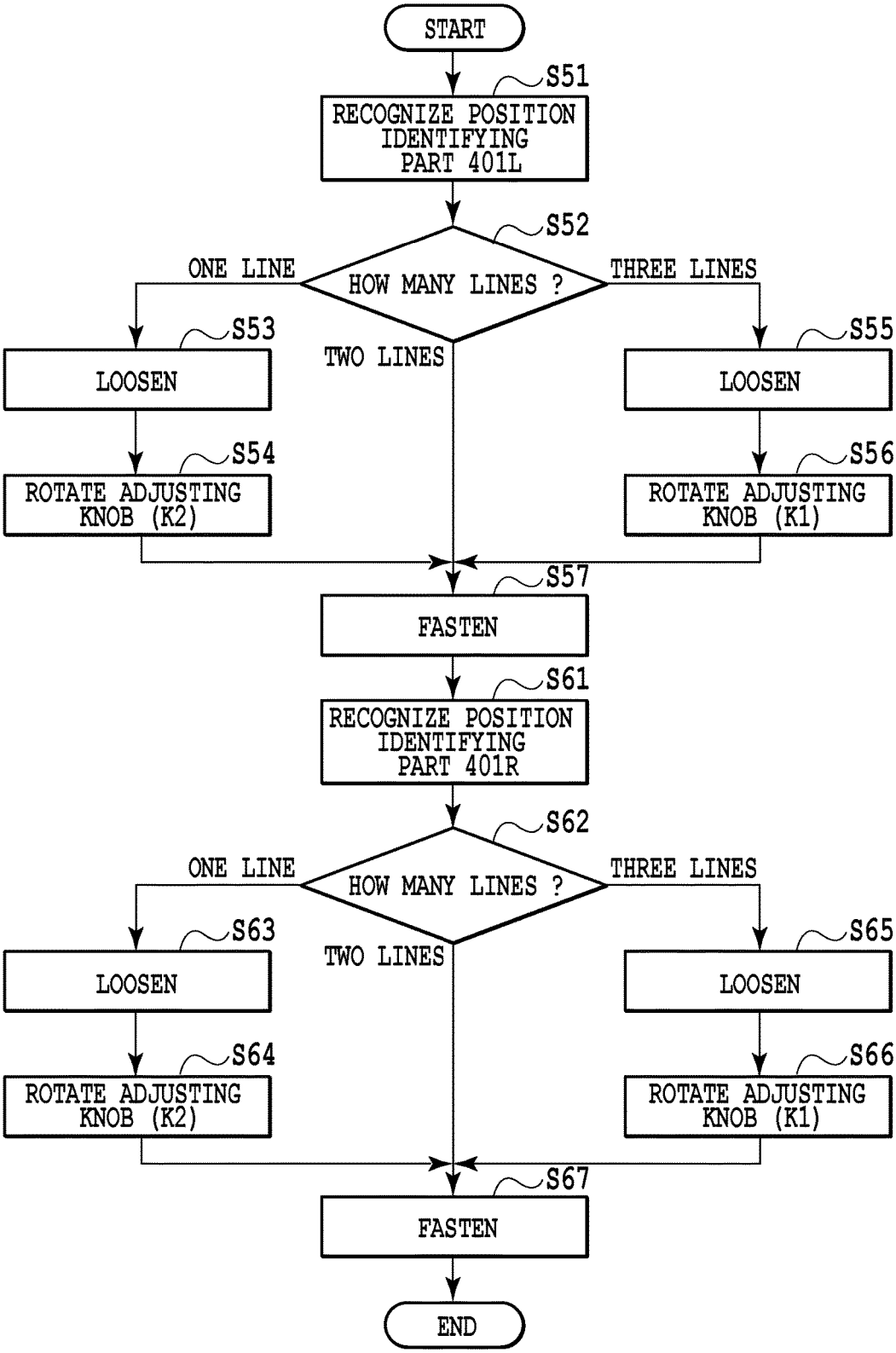
FIG. 27 is a flow chart illustrating a method for adjusting a position between the printer and the stack device.

FIG. 27 is a flow chart illustrating a method for manually adjusting a positional relation between a printer 100 and a stack device 101. Hereinafter, an explanation will be made of the adjustment to positions between the printer 100 and the stack device 101.

First, at step S51 a position identifying part 401L that can determine whether or not a positional relation between the printer 100 and the stack device 101 at the left end is appropriate is viewed by visual contact from above to confirm the position identifying line 411 on a sheet feeding part unit 89. After that, at step S52 it is determined how many position identifying lines 411 are present thereon. In a case of the two position identifying lines 411 (case in FIG. 17A), it is determined that the installing floor of the stack device 101 is formed of a substantially planar face and the positional relation between the printer 100 and the stack device 101 is appropriate, and the process goes to step S57.

In a case of the single position identifying line 411 (case in FIG. 17B), it is determined that the installing floor of the stack device 101 is formed of a convex face and the positional relation between the printer 100 and the stack device 101 is defective, and the process goes to step S53. At step S53 a fixed knob 614 is loosened and at step S54 the adjusting knob 611 is rotated in the K2 direction, and the process goes to step 57.

In a case of the three position identifying lines 411 (case in FIG. 17C), it is determined that the installing floor of the stack device 101 is formed of a concave face and the positional relation between the printer 100 and the stack device 101 is defective, and the process goes to step S55. At step S55 the fixed knob 614 is loosened and at step S56 the loosened fixed knob 614 is fastened.

Subsequently in the processes from step S61 to S66 it is determined whether or not the positional relation in the right side between the printer 100 and the stack device 101 is appropriate in the same method as that in the left side, and the positional adjustment is made as needed.

The positional adjustment between the printer 100 and the stack device 101 is made by such a series of the processes. Thereby even if the printer 100 and the stack device 101 are installed on the floor having the largely uneven surface, an opening port in the sheet conveyance route in each of the printer and the stack device is kept in an appropriate state without being subjected to the influence of the unevenness of the floor. As a result, reliability of the sheet conveyance delivery can be enhanced.

As compared to the first embodiment, the present embodiment has an advantage that since the adjusting knob can make the adjustment in a less rotating amount, the time required for the adjustment can be made shorter and the adjustment procedure is more understandable or the like. On the other hand, because of the need of larger rotating forces, the present embodiment is preferably applied to the adjustment for a relatively light device in weight.

Fourth Embodiment

Hereinafter, an explanation will be made of the fourth embodiment of the present invention with reference to the accompanying drawings. The present embodiment has the structure of enabling an excellent connection between a stack device 101 using a sheet feeding part 80 high in rigidity and a printer 100.

Figure 28A:
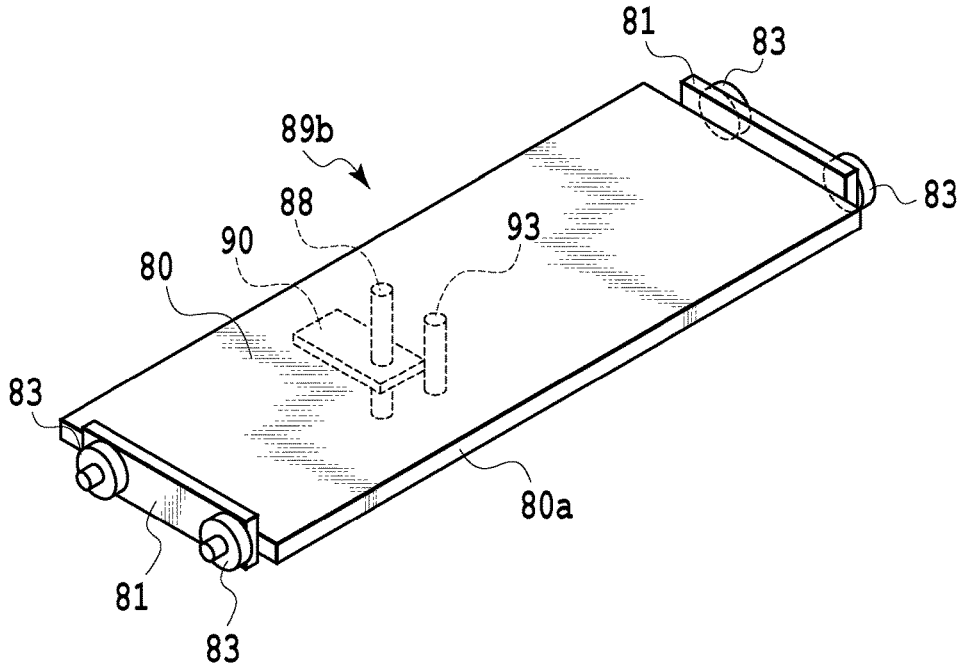
FIG. 28A is a diagram illustrating a sheet feeding part unit in a stack device in a fourth embodiment of the present invention.
Figure 28B:
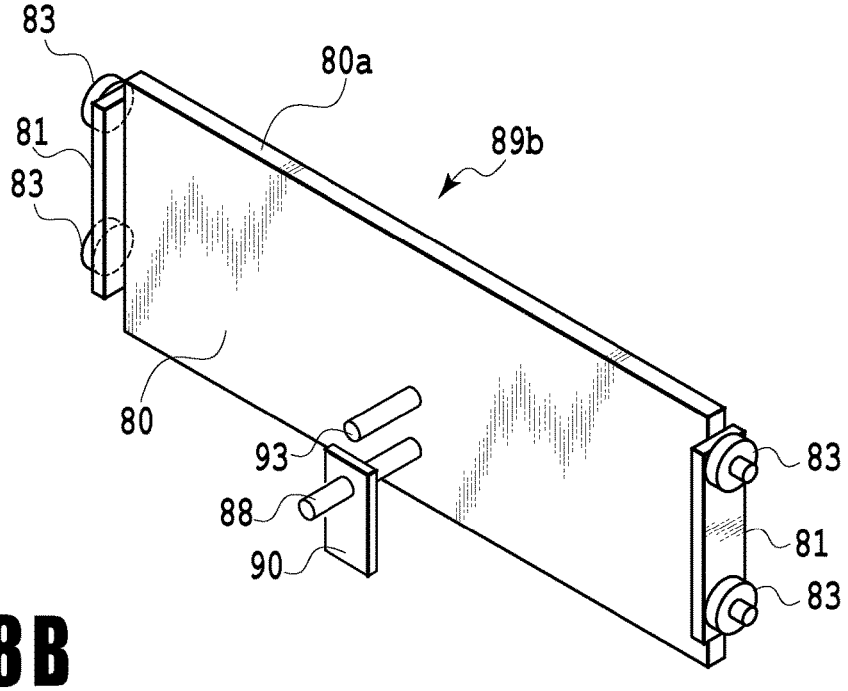
FIG. 28B is a diagram illustrating the sheet feeding part unit in the stack device in the fourth embodiment.

FIG. 28A and FIG. 28B are perspective views each illustrating a sheet feeding part unit 89*b*. The sheet feeding part unit 89*b* is provided with side plates 81 in both ends in the longitudinal direction, and each side plate 81 is provided with two rollers 83 respectively. In addition, a sheet feeding part 80 is provided with a rotational shaft 88 and a rotation restricting shaft 93 on a face of the sheet feeding part 80 at the opposite to a sheet feeding face thereof to be substantially vertical to the opposite face. Further, a rotation stopping member 90 is attached to the rotational shaft 88.

Figure 29A:
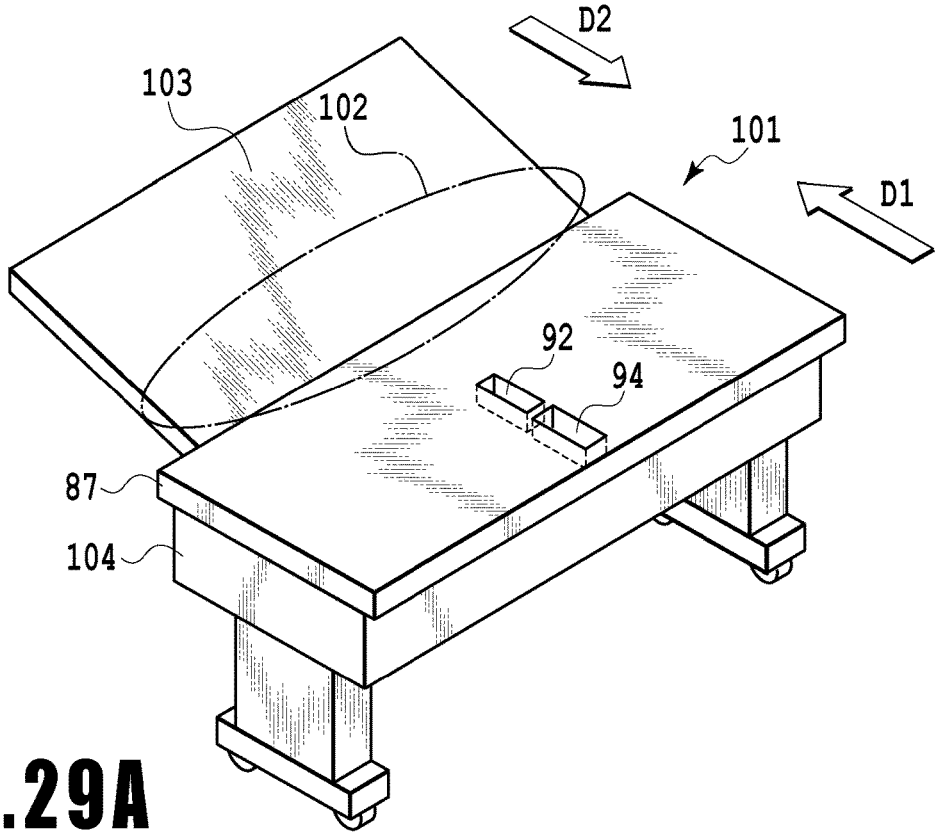
FIG. 29A is a diagram illustrating the sheet feeding part unit in the stack device in the fourth embodiment.
Figure 29B:
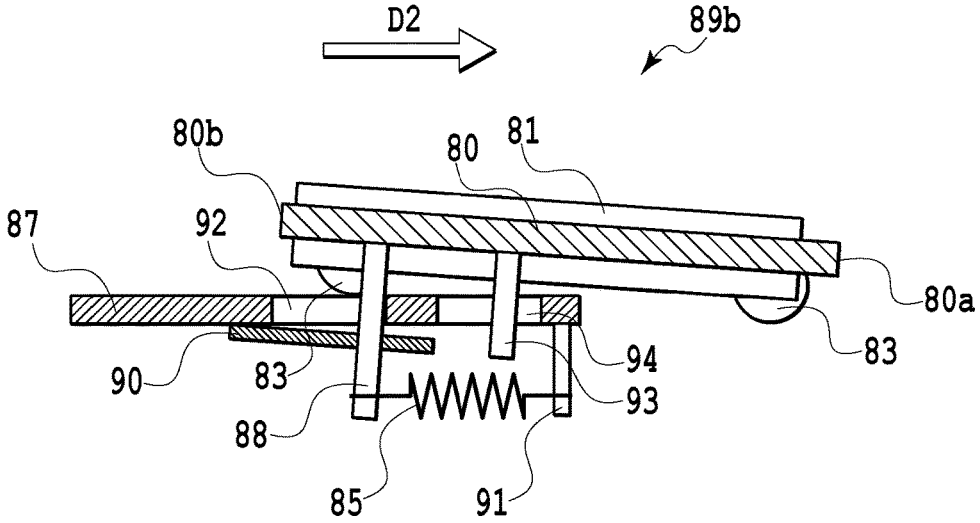
FIG. 29B is a diagram illustrating the sheet feeding part unit in the stack device in the fourth embodiment.

FIG. 29A and FIG. 29B are views each illustrating the stack device 101. A lower stay 87 in the stack device 101 is provided at a longitudinal central part with a sheet feeding part guide groove 92 in which the rotational shaft 88 is inserted and slidable. In addition, the lower stay 87 is provided with a rotation restricting groove 94 for insertion of the rotation restricting shaft 93 ahead of the sheet feeding part guide groove 92 in a direction of arrow D2.

FIG. 29B is a sectional view illustrating a state where the rotational shaft 88 is inserted in the sheet feeding part guide groove 92 and the rotation restricting shaft 93 is inserted in the rotation restricting groove 94. The lower stay 87 is provided with a lower spring engaging part 91, and an urging spring 85 is engaged to the rotational shaft 88 having penetrated the sheet feeding part guide groove 92 and the lower spring engaging part 91. This urging spring 85 urges the sheet feeding part unit 89*b* in a direction of arrow D2. The rotation stopping member 90 is attached to the rotational shaft 88, and the rotation of the sheet feeding part unit 89*b* prevents the rotational shaft 88 from pulling out of the sheet feeding part guide groove 92.

As described in the figure, in a state where the sheet feeding part unit 89*b* is urged in the direction of arrow D2, rollers 83 of the sheet feeding part 80 at both the ends and the rotation stopping part 90 make contact with the lower stay 87 to determine the posture of the sheet feeding part unit 89*b*. A thickness of the sheet feeding part 80 close to a striking part (end part) 80*a* is made thicker as compared to that of a rear part 80*b*, and thereby a center of gravity in the sheet feeding part 80 comes to the forward side. Therefore the stack device 101 that is not connected to the printer 100 keeps the posture where the forward side of the sheet feeding part unit 89*b* in the direction of arrow D2 (end side) is lowered.

Here, an explanation will be made of an operation of the sheet feeding part unit 89*b* at the time a deviation of approximately several mm between the right end and the left end of a striking part 9*d* of a sheet discharge guide in the printer 100 occurs in the direction of arrow D1 as the conveying direction. The sheet feeding part unit 89*b* is rotatable around the rotational shaft 88 (around a shaft crossing the sheet feeding face of the sheet feeding part 80). Therefore the sheet feeding part unit 89*b* can follow the deviation between the right and left ends, and can abut on the striking part 9*d* without producing a space.

The rotation restricting shaft 93 is inserted in the rotation restricting groove 94 to restrict the rotation of the sheet feeding part unit 89*b*. However, the width of the rotation restricting groove 94 is broader in a predetermined range than the thickness of the rotation restricting shaft 93, which therefore allows the sheet feeding part unit 89*b* to rotate in a predetermined range.

Next, an explanation will be made of a case where there occurs a deviation in the height direction between the striking parts at the time of connecting the stack device 101 and the printer 100. When the stack device 101 is pushed into the printer 100 in the direction of arrow D2, the roller 83 provided in the vicinity of the striking part 80*a* rides up a sheet discharge guide inclination part 9*c* (sheet discharge port). The posture of the sheet feeding part unit 89*b* is determined by contact of the roller 83 provided in the vicinity of the striking part 80*a* with the sheet discharge guide inclination part 9*c* and contact of the roller 83 provided in the backward with the lower stay 87 from this point. At this time the rotational shaft 88 can be inclined within the sheet feeding part guide groove 92. Therefore the sheet feeding part unit 89*b* rotates around the backward roller 83 making contact with the lower stay 87.

In this way, when the stack device 101 is pushed toward the printer 100 in the direction of arrow D2, the sheet feeding part unit 89*b* flexibly rotates along the sheet discharge guide inclination part 9*c*, thus making it possible to absorb the deviation of the striking part in the height direction.

Next, an explanation will be made of a case where there occurs a deviation in height between the right and left ends of the sheet discharge guide inclination part 9*c*. The width of the sheet feeding part guide groove 92 in which the rotational shaft 88 is inserted is provided to be wider by a predetermined amount than the width of the rotational shaft 88. Therefore the rotational shaft 88 can be inclined in the longitudinal direction of the sheet feeding part unit 89*b*.

The sheet feeding part unit 89*b* rotates to match the deviation in height between the right and left ends of the sheet discharge guide inclination part 9*c* to be inclined, and abuts on the striking part 9*d* (sheet discharge port) of the sheet discharge guide in the printer 100 by an urging force of the urging spring 85. Therefore the sheet feeding part unit 89*b* can be flexibly inclined along the deviation in height between the right and left ends of the sheet discharge guide inclination part 9*b*, which enables the striking part of the stack device 101 to abut on the striking part of the printer 100.

At this time, because of the high rigidity of the sheet feeding part 80, any of the backward rollers 83 floats up from the lower stay 87, but the step caused thereby is not so large, and there is no possibility that the conveyance defect occurs thereby. Therefore even in a case where the rigidity of the sheet feeding part 80 is high, it is possible to make the appropriate connection between the stack device 101 and the printer 100. When the stack device 101 connected once is separated from the printer 100 to release the connection of both, the sheet feeding part unit 89*b* goes back to the original initial state.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-201070, filed Sep. 30, 2014, which is hereby incorporated by reference wherein in its entirety.

What is claimed is:

1. A receiving device that is connected to a sheet processing device to receive a sheet comprising:

a receiving port that receives the sheet discharged from a discharge port of the sheet processing device along a first direction;

casters that support the receiving device on a floor; and a roller that rides up a support part provided with the sheet processing device at the time of connecting the receiving device and the sheet processing device to receive a part of a weight of the receiving device on the support part, wherein when the roller rides up the support part, a part of the casters floats up from the floor, and the receiving port is positioned to the discharge port, wherein the receiving device further comprises:

a receiving member that receives the sheet in a vicinity of the receiving port, and a support mechanism that supports the receiving member flexibly with respect to the receiving device such that the receiving member is displaced at a time of connecting the receiving device to the sheet processing device to position the receiving port with respect to a reference part provided in a vicinity of the discharge port, wherein the support mechanism includes a first engagement portion and a second engagement portion provided on both sides of the receiving member in a second direction perpendicular to the first direction respectively, each of the first engagement portion and the second engagement portion has a side plate with an elongated hole extending in the first direction, and a shaft being engaged in the elongated hole, wherein the shaft is movable along the elongated hole in each of the first engagement portion and the second engagement portion independently, thereby the receiving member rotatably follows to the reference part.

2. The receiving device according to claim 1, wherein the roller riding on the support part is engaged to the support part not to drop off the support part.

3. The receiving device according to claim 1, wherein a mechanism for height adjustment is provided with a caster that does not float from the floor at the time the roller rides up the support part, among the casters.

4. The receiving device according to claim 3, wherein the mechanism includes a cam mechanism.

5. The receiving device according to claim 1, wherein the roller is provided in a vicinity of one of the casters.

6. The receiving device according to claim 1, wherein each of the first engagement portion and the second engagement portion further has a spring that urges the receiving member in the first direction toward the processing device, wherein when the connection between the receiving device and the sheet processing device is released, the receiving member returns back to an initial state by a force of the spring.

7. The receiving device according to claim 1, wherein the receiving member has a face that supports the sheet thereon and an abutting part that abuts on the reference part of the discharge port, and when the abutting part abuts on the reference part, the receiving member rotatably follows to the reference part by moving in the first direction and rotating with respect an axis of the shaft and an axis that is perpendicular to a surface of the receiving member.

8. The receiving device according to claim 1, wherein the sheet processing device includes a printer, and the receiving device includes a stack device that receives and supports the sheet printed by the printer.

9. A receiving device that is connected to a sheet processing device to receive a sheet comprising:

a receiving port that receives the sheet discharged from a discharge port of the sheet processing device along a first direction;

a receiving member that receives the sheet in a vicinity of the receiving port; and a supports mechanism that support the receiving member flexibly with respect to the receiving device such that the receiving member is displaced at a time of connecting the receiving device to the sheet processing device to position the receiving port with respect to a reference part provided in a vicinity of the discharge port, wherein the support mechanism includes a first engagement portion and a second engagement portion provided on both sides of the receiving member in a second direction perpendicular to the first direction respectively, each of the first engagement portion and the second engagement portion has a side plate with an elongated hole extending in the first direction, and a shaft being engaged in the elongated hole, wherein the shaft is movable along the elongated hole in each of the first engagement portion and the second engagement portion independently, thereby the receiving member rotatably follows to the reference part.

10. The receiving device according to claim 9, wherein each of the first engagement portion and the second engagement portion further has a spring that urges the receiving member in the first direction toward the processing device, wherein when the connection between the receiving device and the sheet processing device is released, the receiving member returns back to an initial state by a force of the spring.

11. The receiving device according to claim 9, wherein the receiving member has a face that supports the sheet thereon and an abutting part that abuts on the reference part of the discharge port, and when the abutting part abuts on the reference part, the receiving member rotatably follows to the reference part by moving in the first direction and rotating with respect an axis of the shaft and an axis that is perpendicular to a surface of the receiving member.

12. The receiving device according to claim 10, wherein the receiving member has a roller as the abutting part.

13. The receiving device according to claim 9, wherein the sheet processing device includes a printer, and the receiving device includes a stack device that receives and supports the sheet printed by the printer.

* * * * *